US011033791B2

(12) United States Patent
McDowell

(10) Patent No.: US 11,033,791 B2
(45) Date of Patent: Jun. 15, 2021

(54) FLIP TOY ASSEMBLY WITH LAUNCHER DEVICE AND PROJECTILE

(71) Applicant: Charles N. McDowell, Newtown Square, PA (US)

(72) Inventor: Charles N. McDowell, Newtown Square, PA (US)

( * ) Notice: Subject to any disclaimer, the term of this patent is extended or adjusted under 35 U.S.C. 154(b) by 0 days.

(21) Appl. No.: 16/852,416

(22) Filed: Apr. 18, 2020

(65) Prior Publication Data

US 2020/0269109 A1 Aug. 27, 2020

Related U.S. Application Data

(63) Continuation-in-part of application No. 15/337,638, filed on Oct. 28, 2016, now Pat. No. 10,625,130.

(51) Int. Cl.
*A63B 67/06* (2006.01)

(52) U.S. Cl.
CPC ..... *A63B 67/06* (2013.01); *A63B 2067/063* (2013.01)

(58) Field of Classification Search
CPC ..... A63B 65/10; A63B 43/002; A63B 65/122; A63B 59/30; A63B 67/06; A63B 2067/063
See application file for complete search history.

(56) References Cited

U.S. PATENT DOCUMENTS 1,514,089 A * 11/1924 Kohler ..... A63B 67/10 473/506
2,009,252 A * 7/1935 Erickson ..... A63F 9/0208 273/337
2,326,676 A * 8/1943 Peters ..... F23J 1/04 294/11
2,493,245 A * 1/1950 Hansen ..... F41J 9/28 124/5
2,688,484 A * 9/1954 Garber ..... A63B 67/04 273/317
3,177,612 A * 4/1965 Giossi ..... A63H 27/004 446/64
3,537,438 A * 11/1970 Reed ..... F41J 9/28 124/5
3,851,880 A * 12/1974 Ritch ..... A63B 59/70 473/471
RE28,467 E * 7/1975 Curtiss ..... A63F 9/0208 273/339
3,901,208 A * 8/1975 Laporte ..... F41J 9/28 124/5
4,111,422 A * 9/1978 Burcenski ..... A63B 67/02 124/5
4,222,361 A * 9/1980 Jackson ..... F41B 3/00 124/5

(Continued)

*Primary Examiner* — Melba Bumgarner
*Assistant Examiner* — Amir A Klayman
(74) *Attorney, Agent, or Firm* — Joseph E. Maenner; Maenner & Associates, LLC

(57) ABSTRACT

A flip toy assembly provides a launcher having and a projectile that is launched and can be caught by the launcher. The launcher has an elongate handle. The handle has a top end and a bottom end, distal from the top end. A head is fixedly attached to the bottom end. A projectile has an apex having a first side and a second side. A first leg extends away from the first side of the apex and a second leg extends away from the second side of the apex. A method of playing a game with the flip toy assembly is also provided.

13 Claims, 34 Drawing Sheets

(56) References Cited

U.S. PATENT DOCUMENTS

| | | | | | |
|---|---|---|---|---|---|
| 4,233,952 | A * | 11/1980 | Perkins | F41B 3/00 | 124/5 |
| 4,347,828 | A * | 9/1982 | Bridgeman | F41B 3/04 | 124/5 |
| 4,881,737 | A * | 11/1989 | Mullins | A63B 53/065 | 473/248 |
| 7,320,489 | B1 * | 1/2008 | Domb | A63B 47/02 | 294/104 |
| 7,665,454 | B1 * | 2/2010 | D'Agostino | F41B 3/04 | 124/5 |
| 7,748,369 | B2 * | 7/2010 | Chee | F41F 7/00 | 124/20.3 |
| 7,900,617 | B1 * | 3/2011 | Kersh | F41J 9/30 | 124/5 |
| 8,015,968 | B2 * | 9/2011 | Christ | F41B 3/04 | 124/5 |
| 8,387,601 | B1 * | 3/2013 | Christensen | A63B 60/34 | 124/5 |
| 9,757,632 | B2 * | 9/2017 | Fryer | A63B 65/122 | |
| 9,889,345 | B2 * | 2/2018 | Chabot | A63B 47/02 | |
| 10,195,503 | B1 * | 2/2019 | Lesh | F41J 9/18 | |
| 10,378,865 | B1 * | 8/2019 | Johannaber | A63B 60/34 | |
| 2005/0143202 | A1 * | 6/2005 | Orlowski | A63B 59/20 | 473/509 |
| 2019/0060714 | A1 * | 2/2019 | Wolfe | A63B 67/02 | |

* cited by examiner

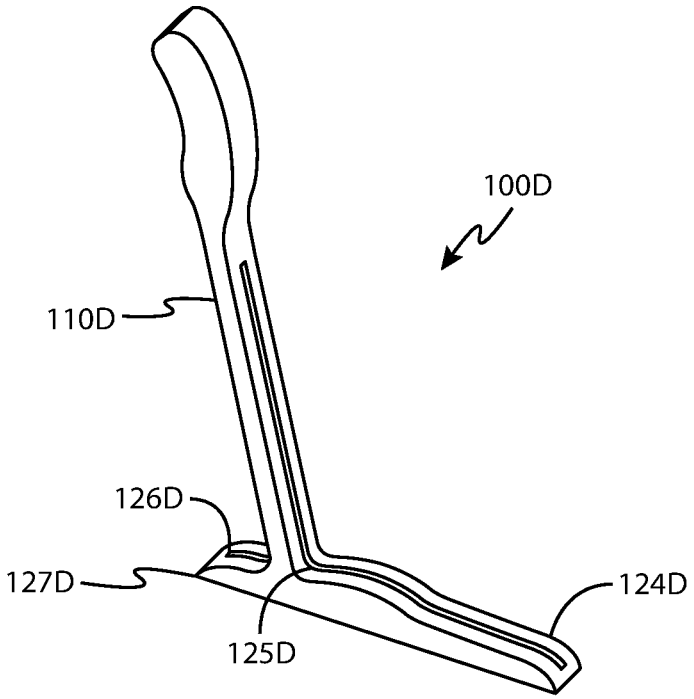
FIG. 2DD
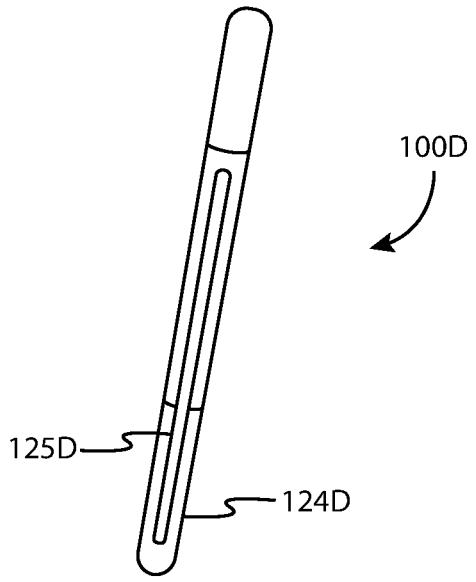
FIG. 2DDD

FLIP TOY ASSEMBLY WITH LAUNCHER DEVICE AND PROJECTILE

CROSS-REFERENCE TO RELATED APPLICATION

This application is a continuation-in-part application of U.S. patent application Ser. No. 15/337,638, filed on Oct. 28, 2016, which claims priority from U.S. Provisional Patent Application Ser. No. 62/247,942, filed on Oct. 29, 2015, both of which are incorporated by reference herein in their entireties.

BACKGROUND OF THE INVENTION

Throw and catch toys are well known to provide entertainment for both humans and animals. It would be beneficial to provide a throw and catch toy that can be used by a single person, multiple, people, or even a person and an animal, such as a dog.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Briefly, the present invention provides a flip toy assembly having a launcher having and a projectile that is launched and can be caught by the launcher. The launcher has an elongate handle. The handle has a top end and a bottom end, distal from the top end. A head is fixedly attached to the bottom end. A projectile has an apex having a first side and a second side. A first leg extends away from the first side of the apex and a second leg extends away from the second side of the apex.

BRIEF DESCRIPTION OF THE DRAWINGS

Aspects, features, and advantages of the present invention will become more fully apparent from the following detailed description, the appended claims, and the accompanying drawings in which like reference numerals identify similar or identical elements.

FIG. 2BB shows a sectional view of another alternative exemplary embodiment of the head end of the launcher/retrieval device shown in FIG. 1, with the projectile shown in FIG. 2B loaded thereon;

FIG. 2CC shows a sectional view of yet another alternative exemplary of the head end of the launcher/retrieval device shown FIG. 1, with projectile shown in FIG. 2C loaded thereon;

FIG. 2DD is a perspective view of an exemplary embodiment of a launcher/retrieval device according to the present invention. They can be used with the projectile shown in FIG. 2D;

FIG. 2DDD is a side elevational view of the launcher/retrieval device shown FIG. 2DD;

DETAILED DESCRIPTION OF THE INVENTION

Figure 1:
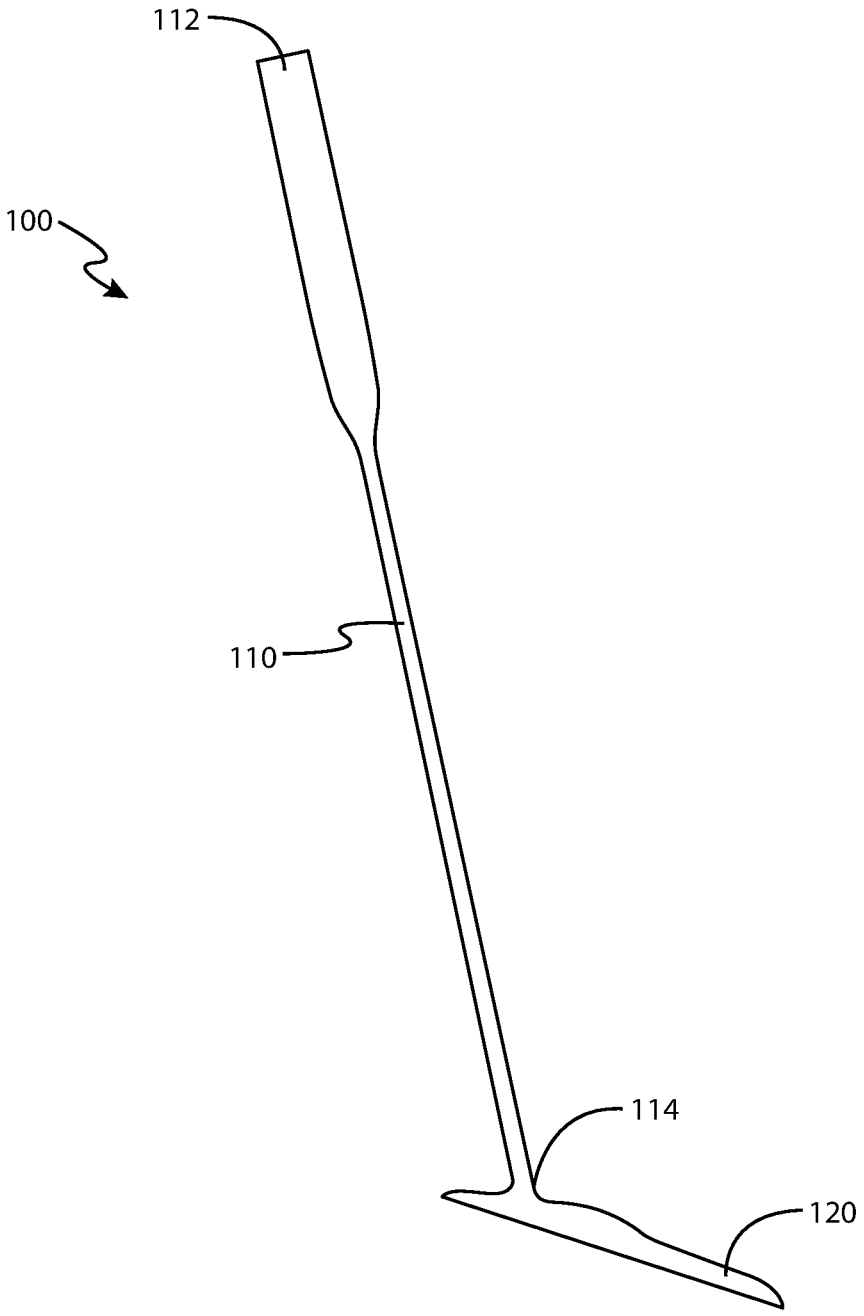
FIG. 1 shows a side elevational view of a launcher/retrieval device according to an exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

FIG. 1 shows a launcher/retrieval device 100 according to an exemplary embodiment of the present invention that is shaped similar to a golf club, such as, for example, a putter. Device 100 includes a handle 110 having a top end 112, a bottom end 114, and a head 120 attached to bottom end 114. Optionally, top end 112 can include a wrist strap (not shown) to prevent a user from inadvertently dropping or throwing launcher/retrieval device 100 during use. In exemplary embodiment, handle 110 extends for a length of about 27 inches, although those skilled in the art will recognize that handle 110 can extend for different lengths as well. Launcher/retrieval device 100 is used to launch and/or retrieve a projectile, such as, for example, any of the projectiles shown in any of FIGS. 4-10C.

Figure 1A:
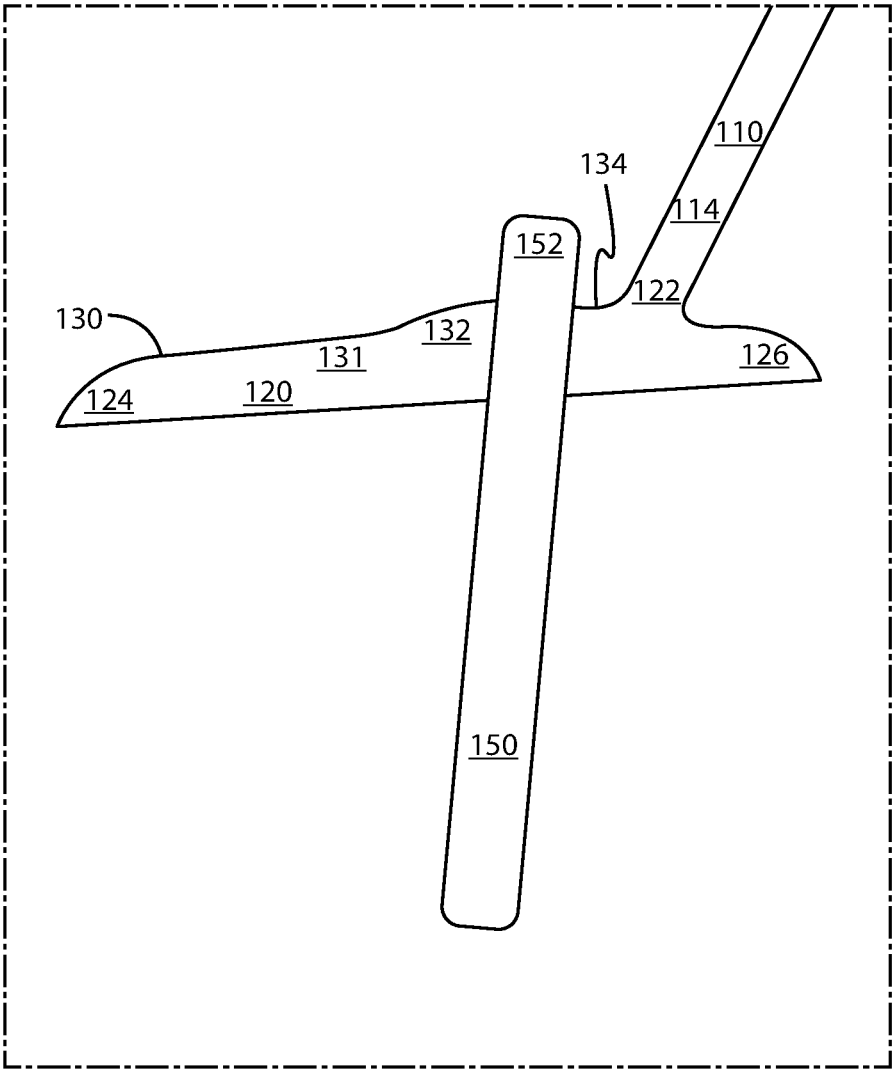
FIG. 1A shows a side elevational view of the launcher/retrieval device shown FIG. 1, with a projectile according to an exemplary embodiment of the present invention mounted thereon.

FIG. 1A shows a projectile 150 (shown FIG. 4) loaded on launcher/retrieval device 100. While projectile 150 is shown with respect to launcher/retrieval device 100, those skilled in the art will recognize that projectile 150 can be used with other embodiments of launcher/retrieval devices disclosed below, and, conversely, other projectiles can also be used with launcher/retrieval device 100 and the other embodiments of launcher/retrieval devices disclosed below. Launcher/retrieval device 100 is used to launch a projectile 150 in the air, either away from the user for another party to catch and/or retrieve with another launcher/retrieval device 100, or proximate to the user for the user to catch on launcher/retrieval device 100. Optionally, handle 110 can be torsionally twisted about a longitudinal axis to help correct the flight of projectile 150 in the event that projectile 150 travels in a direction oblique to its launch direction.

Figure 2:
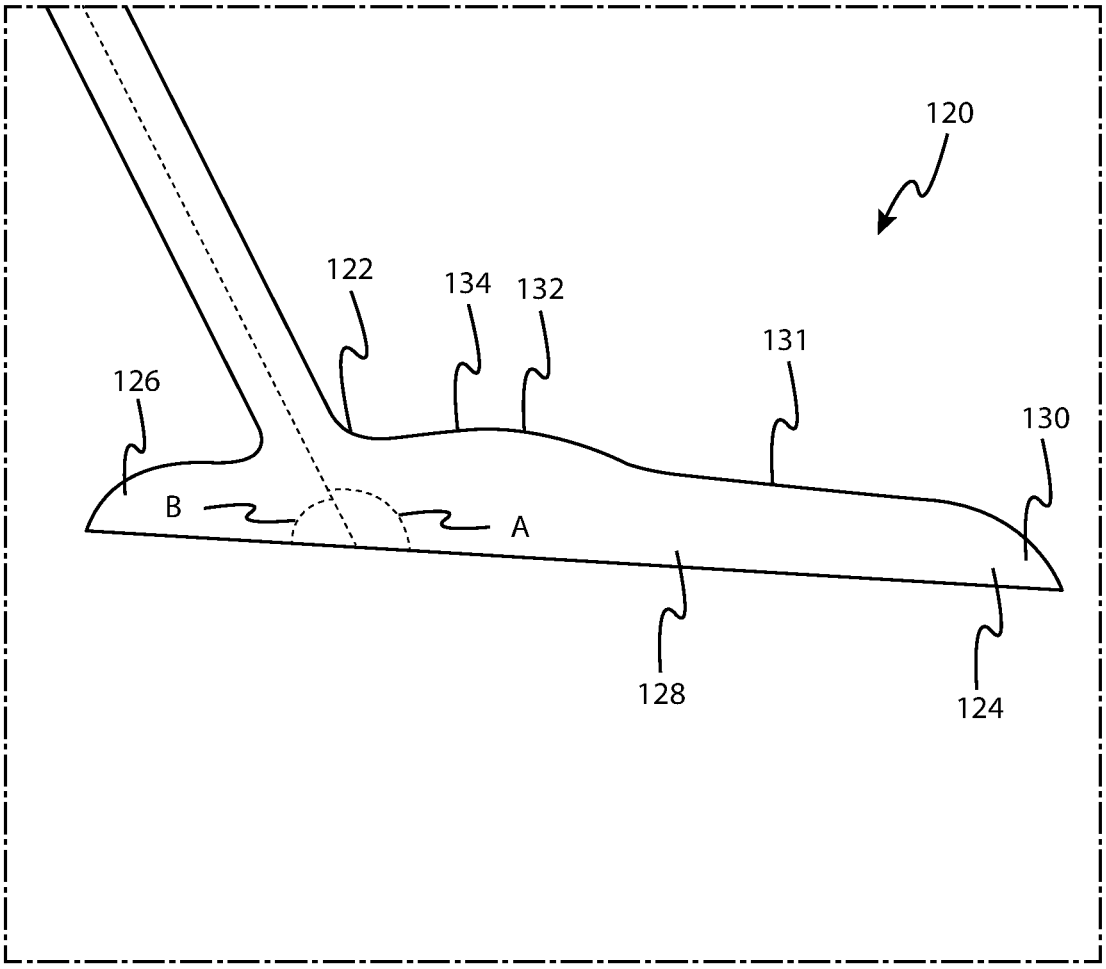
FIG. 2 shows an enlarged view of a head end of the launcher/retrieval device shown in FIG. 1.

Referring to FIG. 2, head 120 includes a connector portion 122 that is connected to the bottom end 114 of handle 110. A first free end 124 of head 120 extends in a first direction from connector portion 122 at an angle A of about 125°, although those skilled in the art will recognize that angle A can be more or less than 125°. In an exemplary embodiment, first free end 124 extends for a distance of about 7 inches, although those skilled in the art will recognize the first free end 124 can extend for a distance of more or less than about 7 inches.

A second free end 126 of head 120 extends in a second direction from connector portion 122 at an angle B of about 55°, although those skilled in the art will recognize that angle B can be more or less than 55°, such that a bottom end of head 120 extends in a generally flat, straight line between first free end 124 and second free end 126. In an exemplary embodiment, second free end 126 extends for distance of about 1½ inches, although those skilled in the art will recognize that second free end 126 can extend for a distance of more or less than about 1½ inches.

First free end 124 includes a generally sloped upward end 130 that generally flattens to an intermediate portion 131 and then rises to a convex hump 132 before settling into a concave receiver 134 adjacent connector portion 122. Second free end 126 sloped upward toward connector portion 122.

Figure 2A:
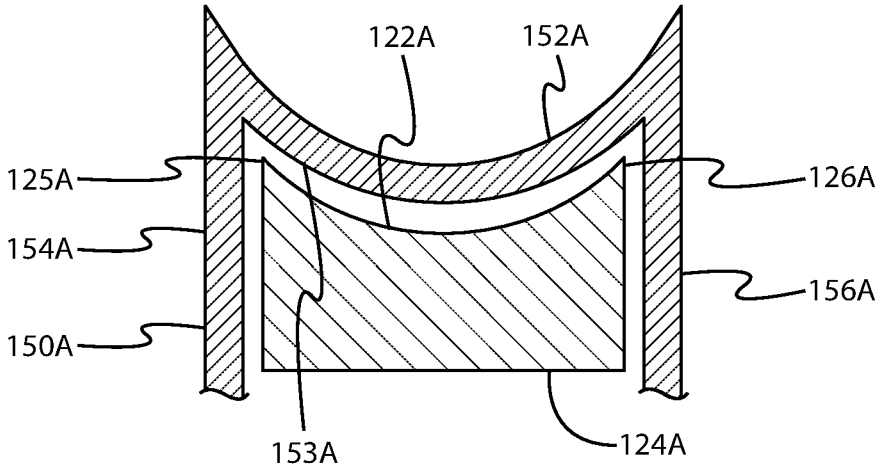
FIG. 2A shows a sectional view of an alternative exemplary embodiment of the head end of the launcher/retrieval device shown in FIG. 1, with an exemplary projectile loaded thereon.

Referring to FIG. 2A, an alternative embodiment of a first free end 124A that can be incorporated into launcher/retrieval device 100 is shown. First free end 124A can have a concave top surface 122A with relatively sharp edges 125A, 126A.

A projectile 150A that can be used with launcher/retrieval device 100 having first free end 124A has an apex 152A having a lower surface 153A that is convex in shape and corresponds with concave top surface 122A, such that, when projectile 150A is loaded onto first free end 124A, apex 152A nestles within top surface 122A. Additionally, the junction between apex 152A and arms 154A and 156A of projectile 150A can be relatively sharp as well to correspond to sharp edges 125A, 126A on first free end 124A. The concavity of top surface 122A and the corresponding shape of apex 152A can provide additional stability for projectile 150A as projectile 150A is cradled on first free end 124A.

Figure 2B:
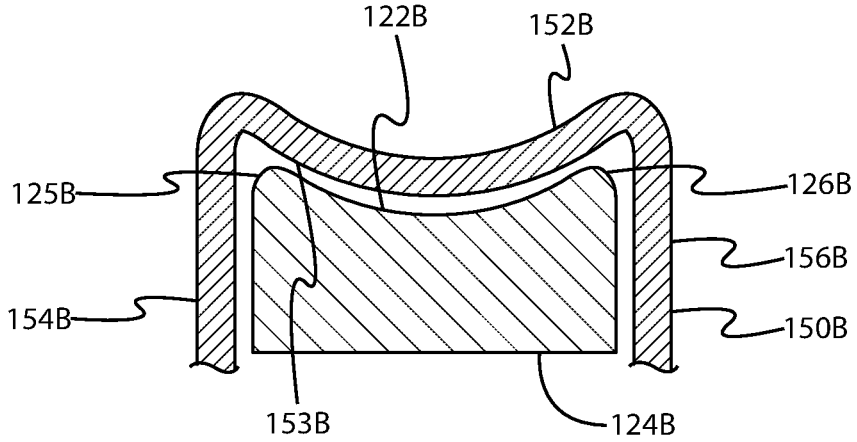
FIG. 2B shows a sectional view of another alternative exemplary embodiment of the head end of the launcher/retrieval device shown in FIG. 1, with an alternative exemplary projectile loaded thereon.

Similarly, referring to FIG. 2B, another alternative embodiment of a first free end 124B that can be incorporated into launcher/retrieval device 100 is shown. First free end 124B can have a concave top surface 122B with rounded convex edges 125B, 126B.

Referring to FIG. 2BB, yet another alternative embodiment of a first free end 124BB that can be incorporated into launcher/retrieval device 100 is shown. First free end 124BB can have a concave bottom surface 123BB with round or convex edges 127BB, 129BB.

A projectile 150B that can be used with launcher/retrieval device 100 having first free end 124B has an apex 152B having a lower surface 153B that is convex in shape and corresponds with concave top surface 122B, such that, when projectile 150B is loaded onto first free end 124B, apex 152B nestles within top surface 122B. Additionally, the junction between apex 152B and arms 154B and 156B of projectile 150B can be rounded as well to correspond to rounded edges 125B, 126B on first free end 124B. Similar to above, the concavity of top surface 122B and the corresponding shape of apex 152B can provide additional stability for projectile 150B as projectile 150B is cradled on first free end 124B. Still similarly, referring to FIG. 2C, still another alternative embodiment of a first free end 124C that can be incorporated into launcher/retrieval device 100 is shown. First free end 124C can have a convex top surface 122C and projectile 150C can have an apex 152C that has a generally concave inner surface 153C that corresponds to the surface contour of convex top surface 122C. Similar to above, the convex top surface 122C and the corresponding shape of apex 152C can provide additional stability for projectile 150C as projectile 150C is cradled on first free end 124C.

Figure 2C:
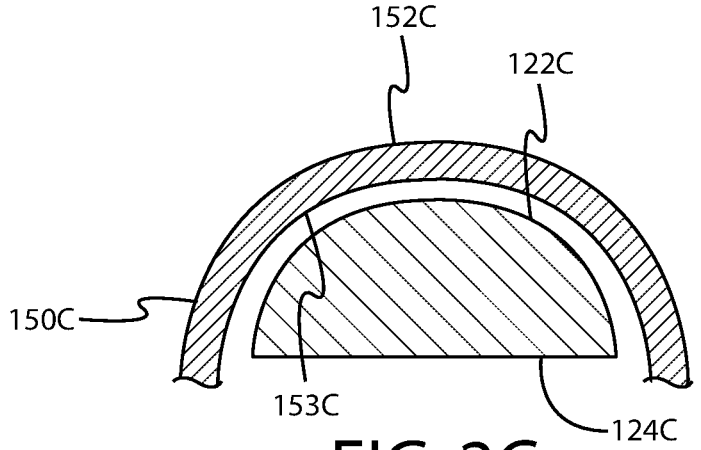
FIG. 2C shows a sectional view of still another alternative exemplary embodiment of the head end of the launcher/retrieval device shown in FIG. 1, with still another alternative exemplary projectile loaded thereon.
Figure 2B:
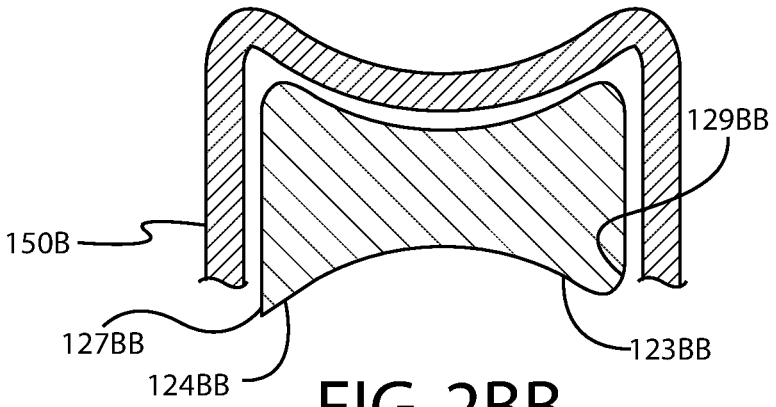
Figure 2C:
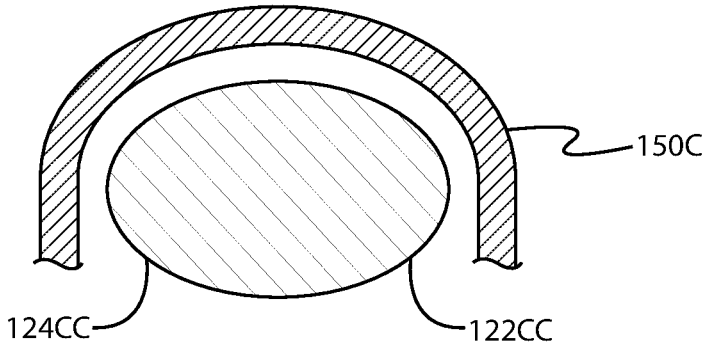

Referring to FIG. 2CC, yet another alternative embodiment of a first free end 124CC that can be incorporated into launcher/retrieval device 100 is shown. First free end 124CC can have a convex bottom surface 122CC.

Figure 2D:
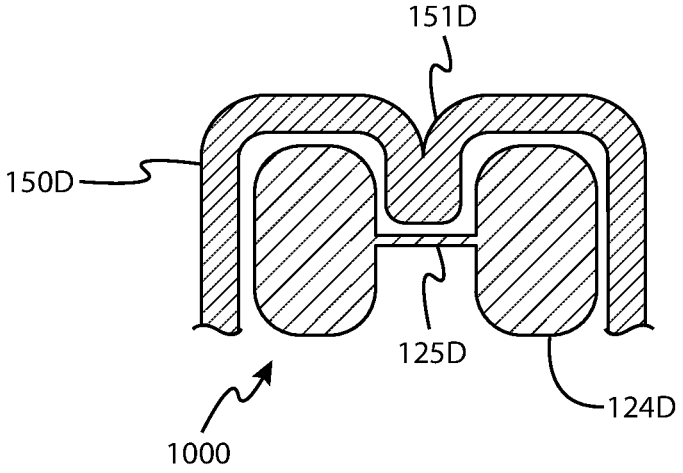
FIG. 2D shows a sectional view of another alternative exemplary embodiment of the head end of the launcher/retrieval device shown in FIG. 1, with yet another alternative exemplary projectile loaded thereon.

Referring to FIG. 2D, still another alternative embodiment of the first free end 124D that can be incorporated into a launcher/retrieval device 100D according to an exemplary embodiment of the present invention is shown. First free end 124D includes a longitudinal slot 125D that extends at least partially along the length of first free end 124D. A projectile 150D can be shaped similarly to projectile 150C, but with a central rib 151D that is sized to fit into slot 125D. As shown FIG. 2D, slot 125D extends along both the top surface and a bottom surface of first free end 124D.

As shown FIGS. 2DD and 2DDD, slot 125D can extend the entire length of first free end 124D, as well as at least partially along handle 110D. Also, as shown FIG. 2DDD, a slot 126D can also extend along the top of second free end 127D. The slots and corresponding central rib 151D allow projectile 150D to ride up along launcher/retrieval device 100D, allowing the user to perform tricks with projectile 150D.

Figure 3:
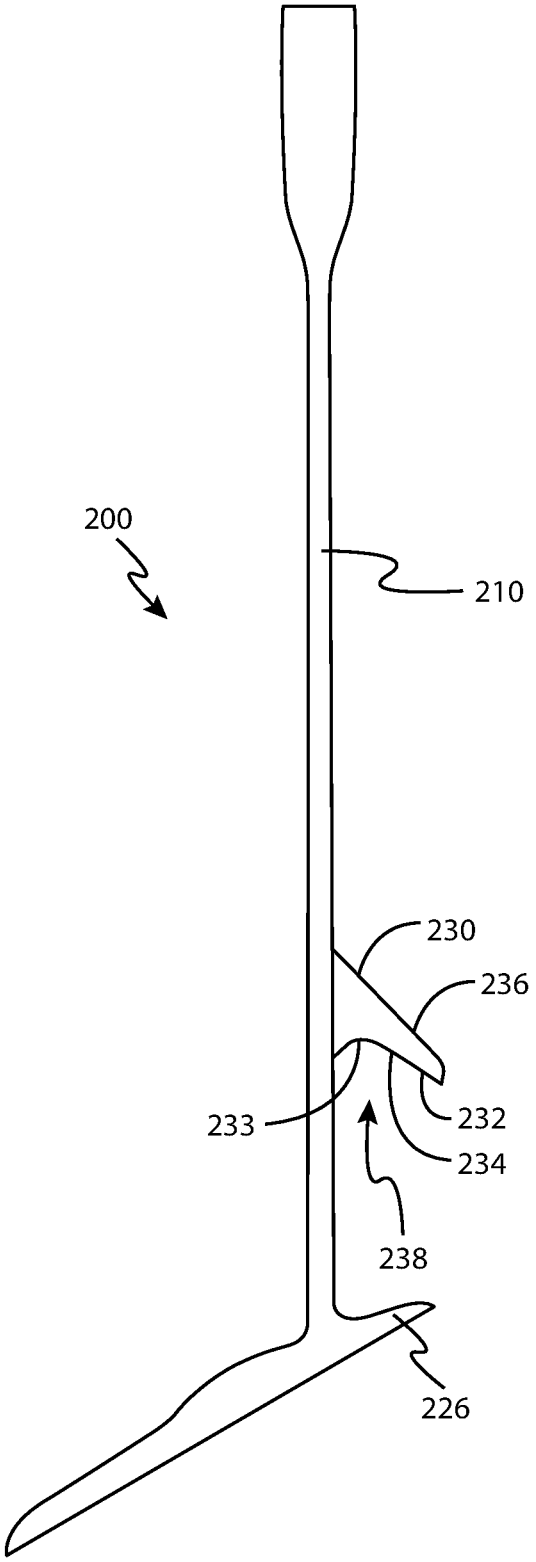
FIG. 3 shows a side elevational view of an alternative exemplary embodiment of a launcher/retrieval device according to the present invention.

Referring to FIG. 3, a second exemplary embodiment of a launcher/retrieval device 200 according to the present invention is shown. Launcher/retrieval device 200 is similar to launcher/retrieval device 100 discussed above with the addition of a hook 230 that extends rearward from handle 210. Hook 230 includes a downward sloping face 232. Optionally, hook 230 can also include an upward sloping face 233 that extends upwardly and away from handle 210 such that an apex 234 is formed at the intersection of downward sloping face 232 and upward sloping face 233. Still optionally, hook 230 can include a top surface 236 that slopes downwardly and away from handle 210.

As shown in FIG. 3, a vertical space 238 is formed alongside handle 210 between second free end 226 and hook 230. Vertical space 238 allows a projectile according to the present invention to be mounted on a second free end 226 and to allow movement of the projectile upward along handle 210 only until the projectile engages hook 230, restricting the ability of the projectile to move farther vertically upward along handle 210 and potentially inadvertently strike the user or another party standing close to the user. Hook 230 can be located anywhere along the length of handle 210 above second free end 226.

Figure 3A:
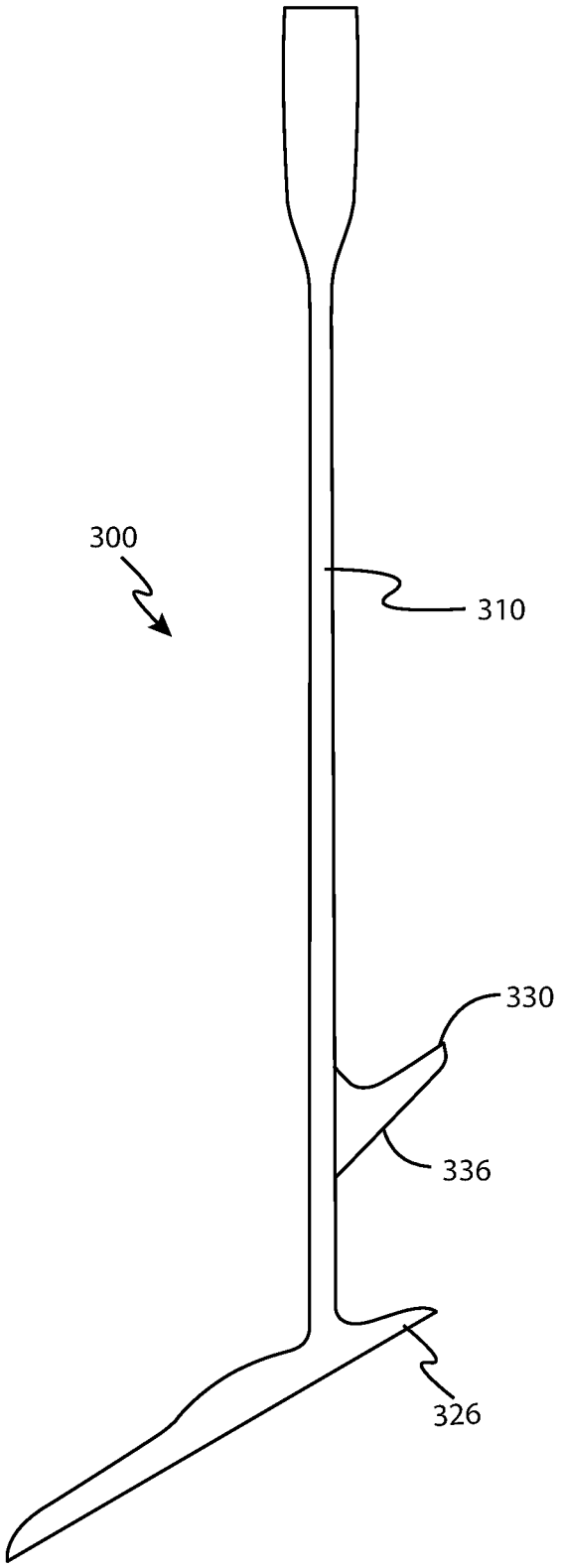
FIG. 3A shows a side elevational view of still another alternative exemplary embodiment of a launcher/retrieval device according to the present invention.

Referring to FIG. 3A, a third exemplary embodiment of a launcher/retrieval device 300 according to the present invention is shown. Launcher/retrieval device 300 is similar to launcher/retrieval device 200 discussed above, the exception that hook 330, which is similar to hook 230, is reversed, resulting in a bottom surface 336 being sloped upwardly and away from handle 310 to deflect a projectile that may have been inadvertently thrust upwardly from second free end 326 away from the user. Optionally, hook 330 can be removable and reinstallable onto launcher/retrieval device 300 such that launcher/retrieval device 200 is formed.

Optionally, each of launcher/retrieval device 100, 200, 300 may include a plurality of voids or holes formed throughout. A first advantage of the presence of the voids is to reduce the total weight of launcher/retrieval device 100, 200, 300. A second advantage of the voids, particularly in handles 110, 210, 310, is to impart additional flexibility to handles 110, 210, 310, which may provide the user with the ability to perform additional tricks, stunts, or maneuvers with launcher/retrieval device 100, 200, 300.

FIGS. 4-10 show exemplary embodiments of projectiles that can be used with launcher/retrieval devices 100, 200, 300 according to the present invention. While exemplary projectiles are shown, those skilled in the art will recognize that other types of projectiles may be used within the scope of the present invention.

Figure 4:
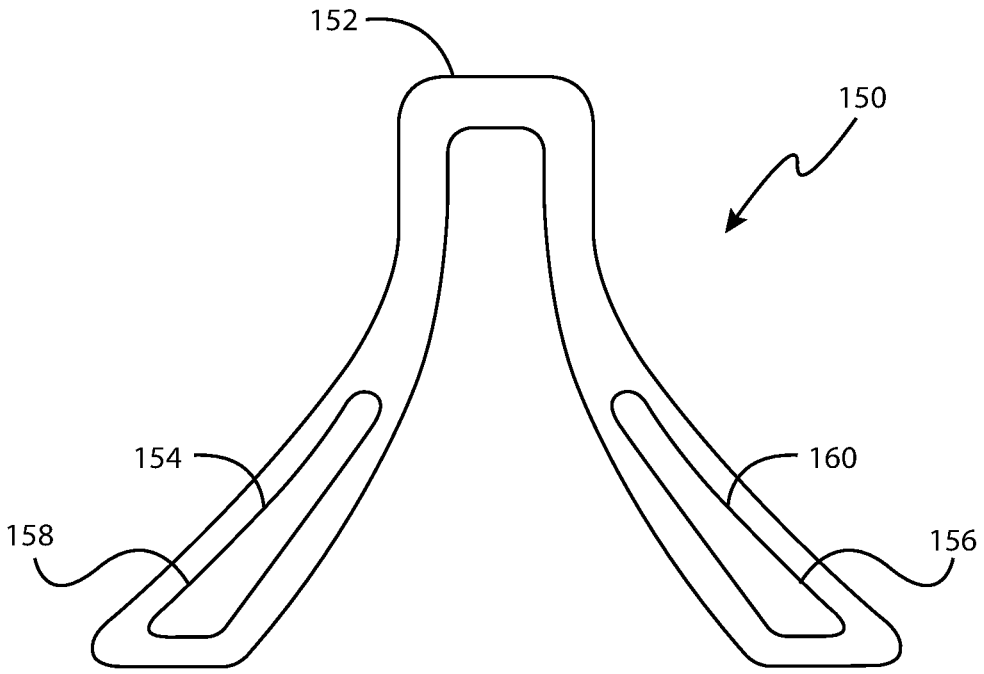
FIG. 4 shows a side elevational view of an exemplary embodiment of a projectile for use with any disclosed embodiment of the launcher/retrieval device according to the present invention.

Referring to FIG. 4, a first exemplary embodiment of a projectile 150 according to the present invention is shown. Projectile 150 is retained on head 120 and launched by a user by flicking handle 110.

Figure 4A:
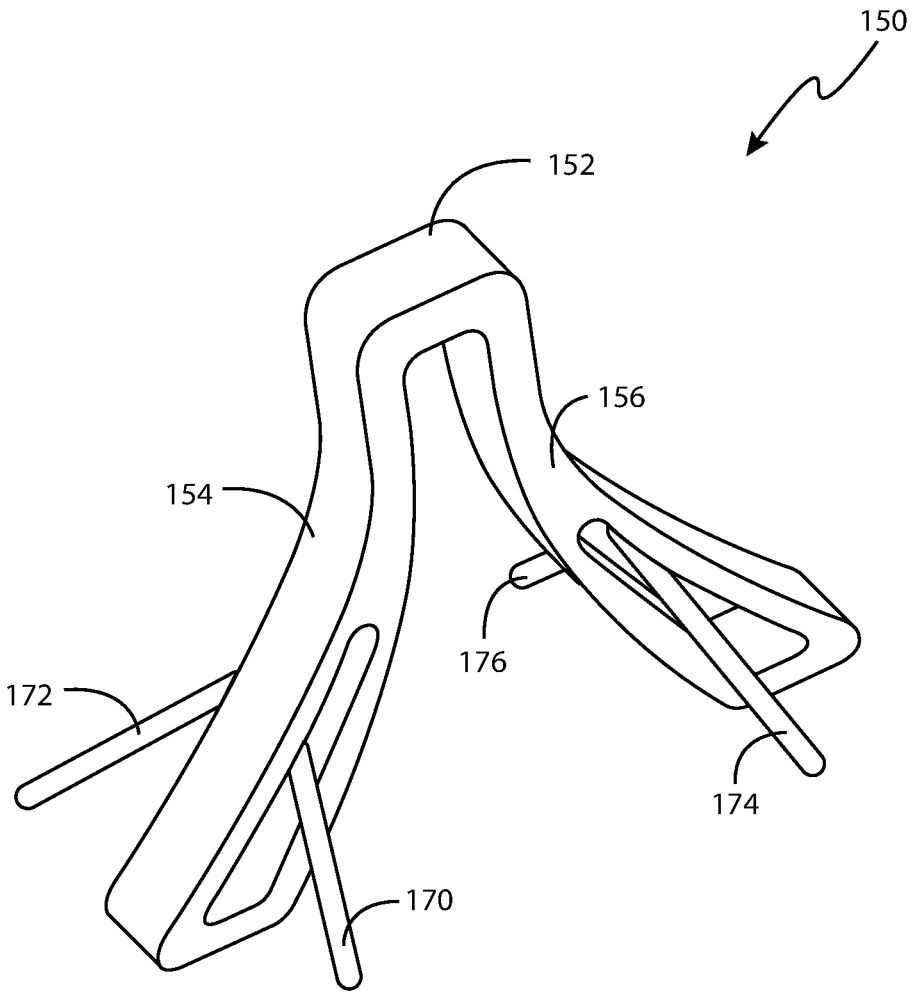
FIG. 4A shows a perspective view of yet another alternative exemplary embodiment of a projectile for use with any disclosed embodiment of the launcher/retrieval device according to the present invention.

Referring to FIG. 4A, supports 170, 172 extend outwardly from either side of arm 154 and supports 174, 176 extend outwardly from either side of form 156. Supports 170, 172, 174, 176 allow projectile 150 to stand upright. Optionally, supports 170, 172, 174, 176 can be constructed from glow sticks that allow projectile 150 to be seen in the dark.

In an exemplary embodiment, projectile 150 includes a generally flat apex 152 having a length that is about as wide as head 120. A longitudinal centerline 153 bisects projectile 150. Arms 154, 156 are generally curved to extend away from apex 152 and generally diverge away from centerline 153. In an exemplary embodiment, material is removed from each of arms 154, 156, forming holes 158, 160, respectively. Holes 158, 156 assist in weight distribution to balance projectile 150.

Figure 5:
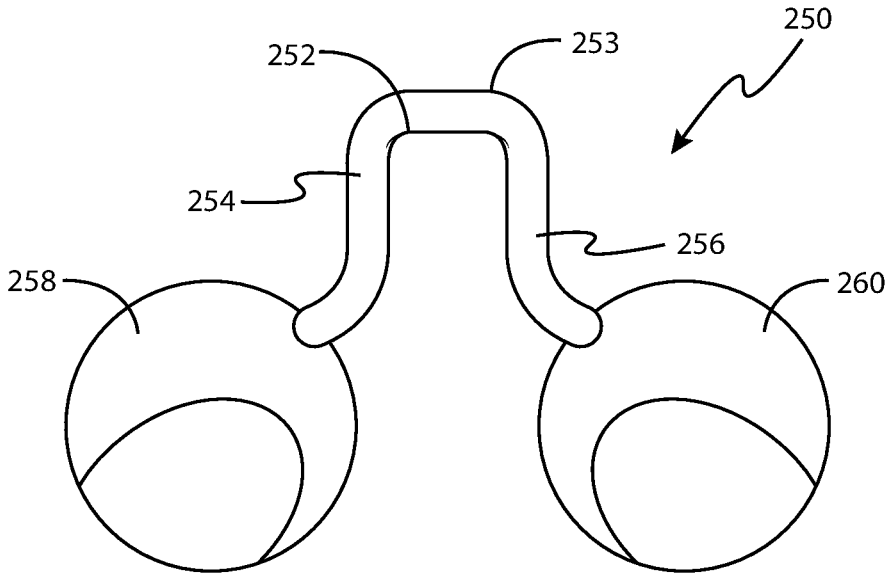
FIG. 5 shows a side elevational view of an alternative exemplary embodiment of a projectile for use with any disclosed embodiment of the launcher/retrieval device according to the present invention.

Referring to FIG. 5, an alternative embodiment of a projectile 250 is shown. Projectile 250 includes a generally flat apex 252 having a length that is about as wide as head 120. A longitudinal centerline 253 bisects projectile 250. Arms 254, 256 are generally curved to extend away from apex 252 and generally divert away from centerline 253. Instead of, or on addition to, holes 158, 156, however, distal ends of arms 254, 256 include spheres 258, 260, such as, for example, tennis balls, sponge balls, or other relatively soft material.

Still alternatively, apex 252 can be constructed from a rigid material, such as a high density plastic, while arms 254, 256 can be constructed from a soft material, such as a rubber, a sponge, or other similar material. Still alternatively, arms 234, 256 can also be constructed from a rigid material, and covered with a soft material.

Figure 6:
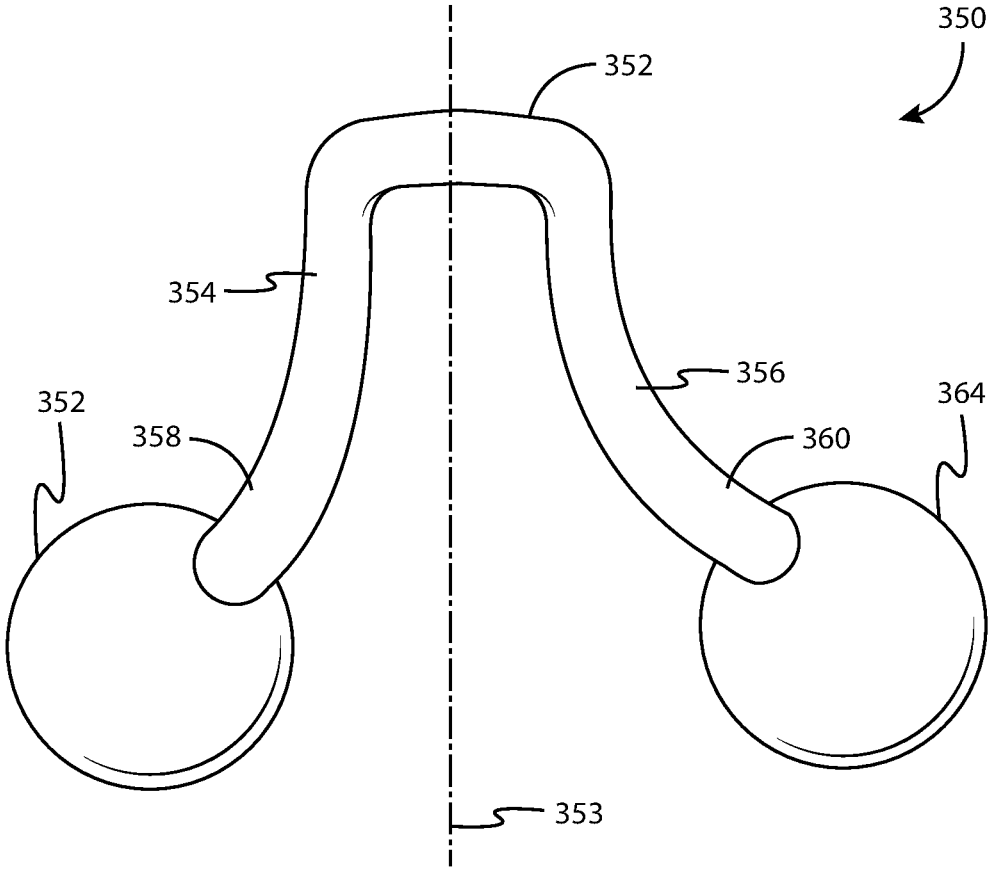
FIG. 6 shows a side elevational view of another alternative exemplary embodiment of a projectile for use with any disclosed embodiment of the launcher/retrieval device according to the present invention.

Referring to FIG. 6, an alternative embodiment of a projectile 350 is shown. Projectile 350 includes a generally flat apex 352 having a length that is about as wide as head 120. A longitudinal centerline 353 bisects projectile 250. Arms 354, 356 are generally straight and extend away from apex 252 and generally parallel to centerline 253. Arm extensions 358, 360 extend from their respective arms 354, 356, away from longitudinal centerline 353. Distal ends of arm extensions 358, 360 includes fierce 362, 364, respectively.

Figure 6A:
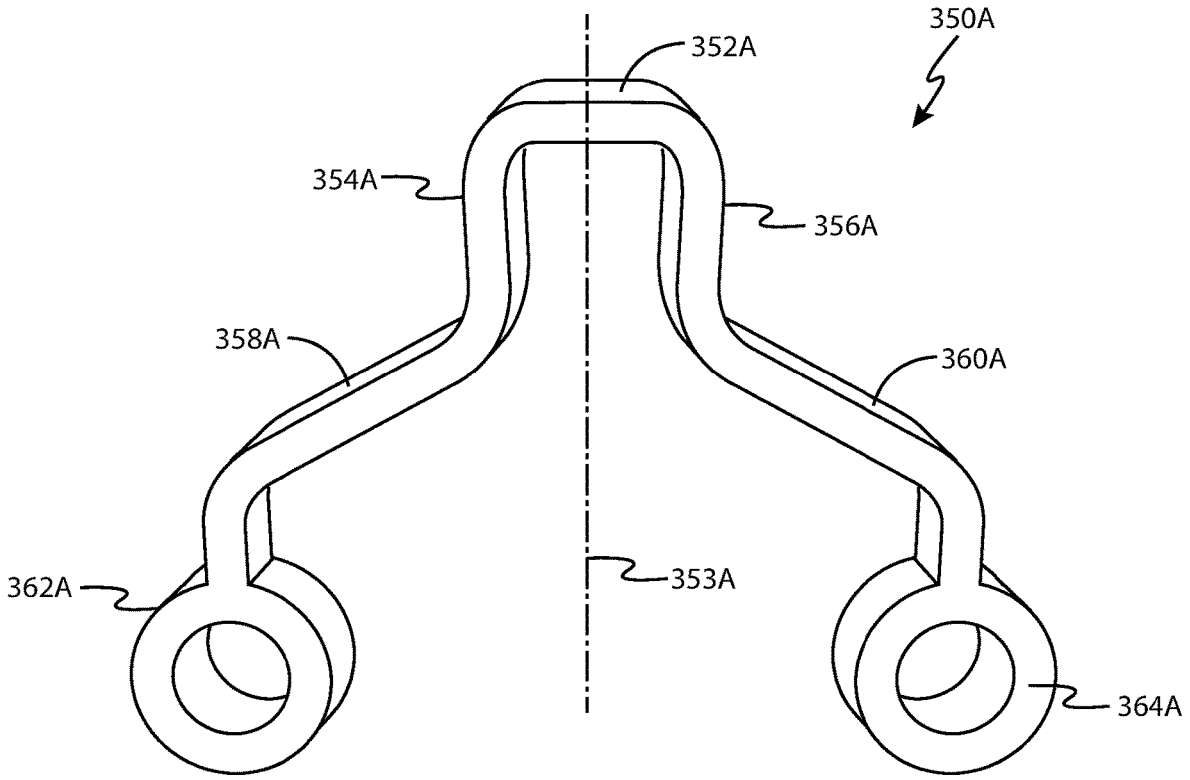
FIG. 6A shows a side elevational view of another alternative exemplary embodiment of a projectile for use with any disclosed embodiment of the launcher/retrieval device according to the present invention.

While spheres 362, 364 are shown, those skilled in the art will recognize that distal ends of arm extensions 358, 360 can include other devices that provide a weight such as, for example projectile 350A shown in FIG. 6A, which includes annular members 362A, 364A, respectively, at the ends thereof. The weights at the end of the projectiles, distal from each apex, are used to balance the projectile when the projectile is seated on its respective launcher/retrieval device and to also balance the projectile when the projectile is in the air.

Figure 7:
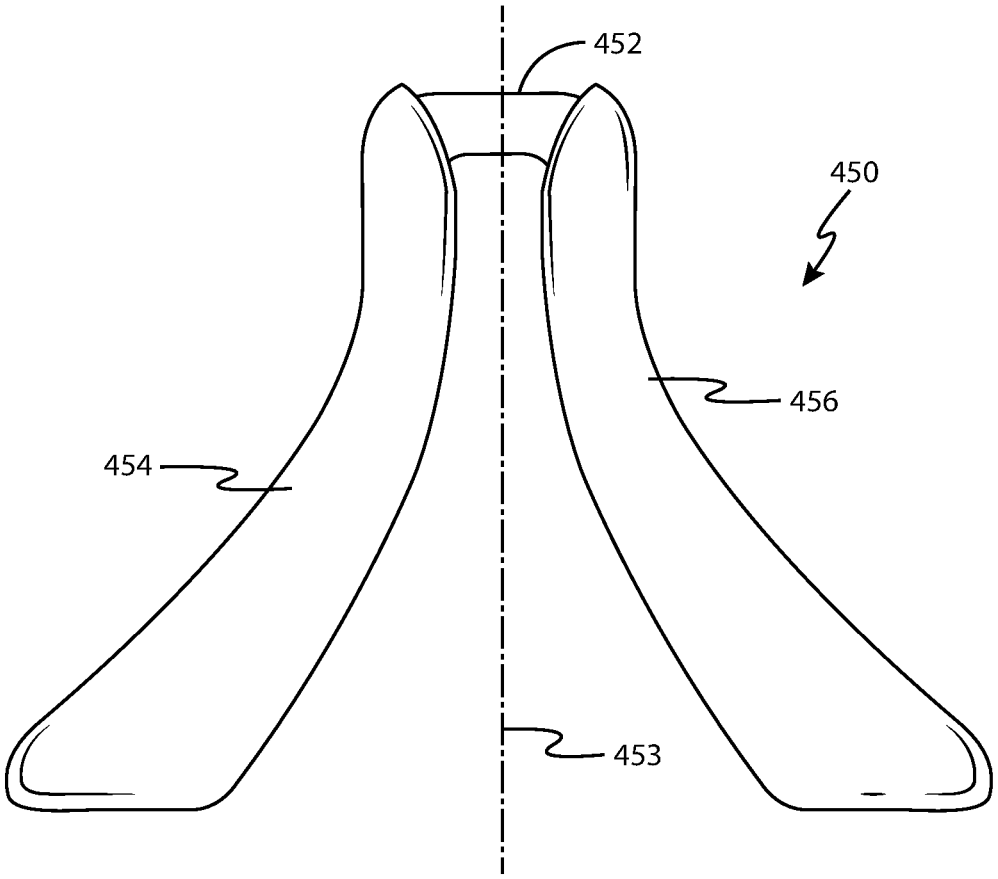
FIG. 7 shows a side elevational view of another alternative exemplary embodiment of a projectile for use with any disclosed embodiment of the launcher/retrieval device according to the present invention.

Referring to FIG. 7, another alternative embodiment of a projectile 450 is shown. Projectile 450 includes a generally flat apex 452 having a length that is about as wide as head 120. A longitudinal centerline 453 bisects projectile 450. Similar to projectile 150, arms 454, 456 are generally curved to extend away from apex 452 and generally diverge away from centerline 453. In an exemplary embodiment, arms, 454, 456 are at least partially coated or covered with a soft material, such as, for example, a foam padding so that, in the event that projectile 450 strikes a person, projectile 450 has a low tendency to be able to injure the person. Additionally, the foam padding provide a soft grip for an animal, such as, for example, a dog, to pick up projectile 450 with its mouth after projectile 450 has been launched by launcher/retrieval device.

Figure 8:
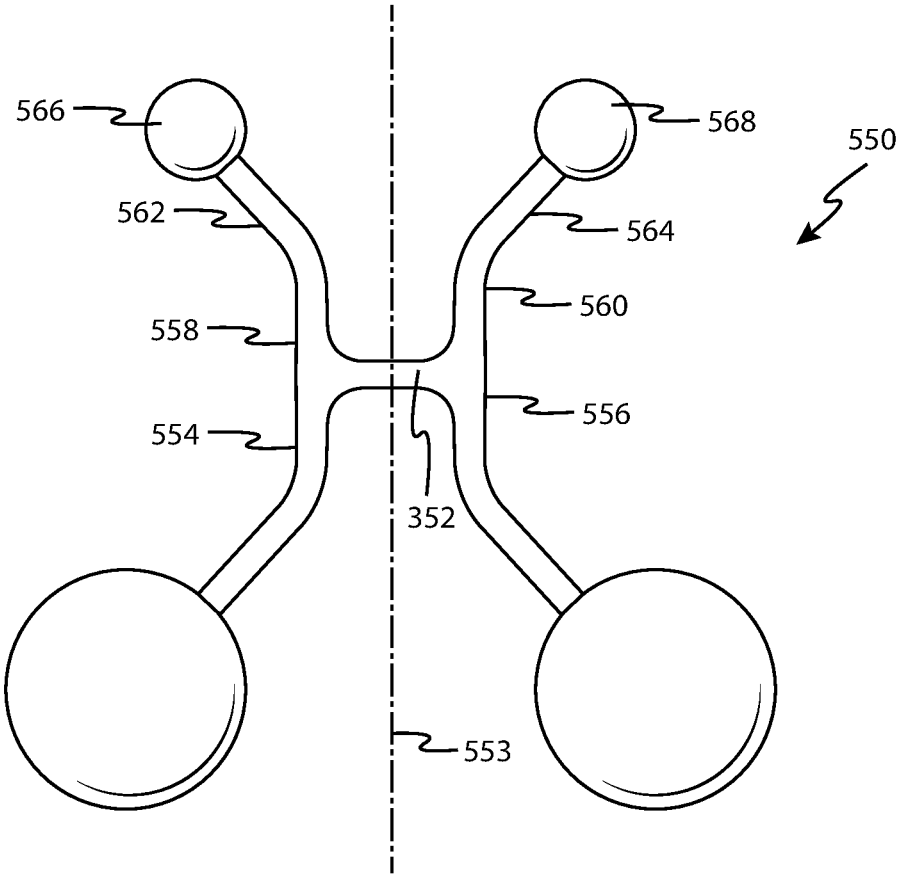
FIG. 8 shows a side elevational view of another alternative exemplary embodiment of a projectile for use with any disclosed embodiment of the launcher/retrieval device according to the present invention.
Figure 9:
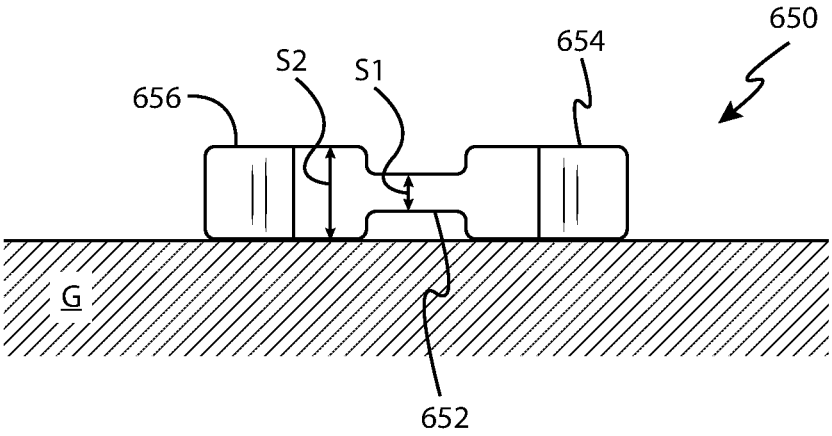
FIG. 9 shows a front elevational view of another alternative exemplary embodiment of a projectile for use with any disclosed embodiment of the launcher/retrieval device, with the projectile lying on the ground, according to the present invention.

FIG. 8 shows still another alternative embodiment of a projectile 550. Projectile 550 is similar to projectile 350, with the exception that, at apex 552, in addition to arms 554, 556 that extend generally parallel to a longitudinal centerline 553 in one direction, a second set of arms 558, 560 extend away from apex 552 in an opposing direction. Arm extensions 562, 564 extend from their respective arms 558, 560 away from longitudinal centerline 553, and terminate in counterweights 566, 568, respectively. Counterweights 566, 568 add balance to projectile 550 while projectile 550 is in flight. Additionally, counterweights 566, 568 also serve to lift apex 552 of the ground when projectile 550 itself is on the ground, making it easier to slide first free end 124 of head 120 underneath apex 552 to engage projectile 550 and lift projectile 550 from the ground.

In an alternative embodiment of any of the projectiles described above, a projectile 650, shown in FIG. 9 includes an apex 652 that has a narrow cross-section S1, that is smaller than the cross-section S2 of arms 654, 656 such that, when projectile 650 is lying on the ground G, a space is formed between ground G and apex 652, enabling first free end 124 of head 120 to be able to slide underneath apex 652 to engage projectile 650 and lift projectile 650 from ground G.

In still another alternative embodiment of any of the projectiles described above, a projectile 750, shown in FIG. 10, includes pins 760, 762 that extend outwardly from each of the arms of projectile 750 (only arm 754 is shown). Pins 760, 762 are located proximate to apex 752 and serve to lift apex 752 away from ground G such that, when projectile 750 is on ground G, a space is formed between ground G and apex 752, enabling first free end 124 of head 120 to be able to slide underneath apex 752 to engage projectile 750 and lift projectile 750 from ground G.

Figure 10:
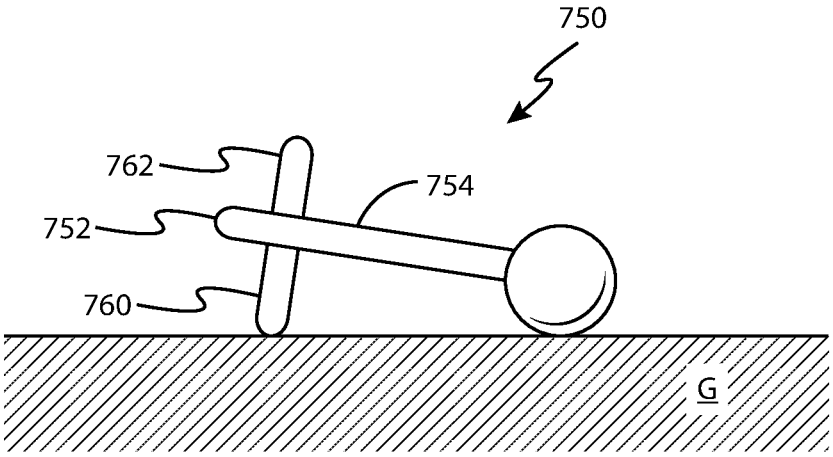
FIG. 10 shows a front elevational view of still another alternative exemplary embodiment of a projectile for use with any disclosed embodiment of the launcher/retrieval device, with the projectile lying on the ground, according to the present invention.
Figure 10A:
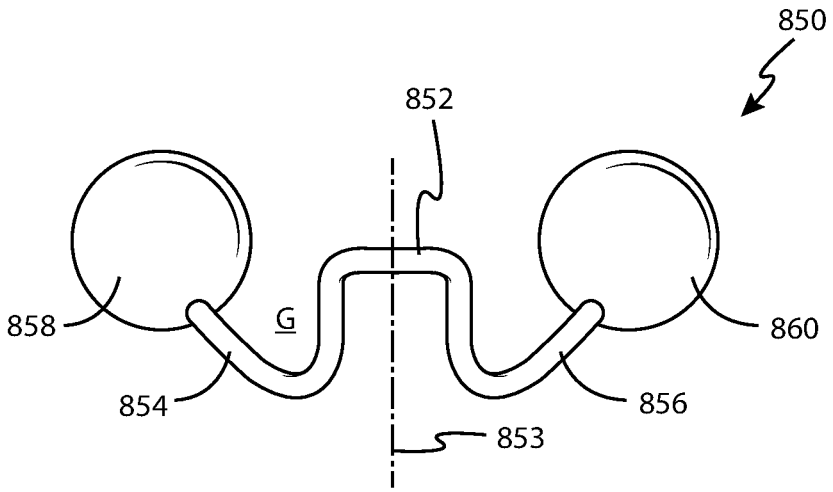
FIG. 10A shows a rear perspective view of still another alternative exemplary embodiment of a projectile for use with any disclosed embodiment of the launcher/retrieval device, with the projectile lying on the ground, according to the present invention.
Figure 10B:
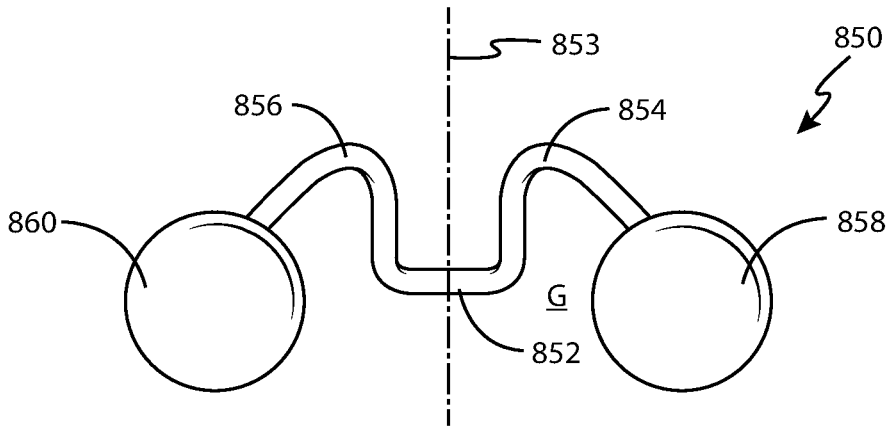
FIG. 10B shows a rear perspective view of the projectile shown in FIG. 10A, with the projectile lying upside down on the ground.

FIGS. 10A and 10B show another alternative embodiment of a projectile 850 according to the present invention. Projectile 850 includes an apex, 852 and arms 854, 856, respectively that extend downwardly and away from apex 852 and a central axis 853 in a curved fashion. Balls 858, 860 are provided on the end of each arm 854, 856, respectively. As shown in FIG. 10A, projectile 850 can land on the ground G with apex 852 extended away from ground G or, alternatively, as shown FIG. 10B, projectile 850 can land on the ground G with apex 852 are engaged with the ground G.

Figure 10C:
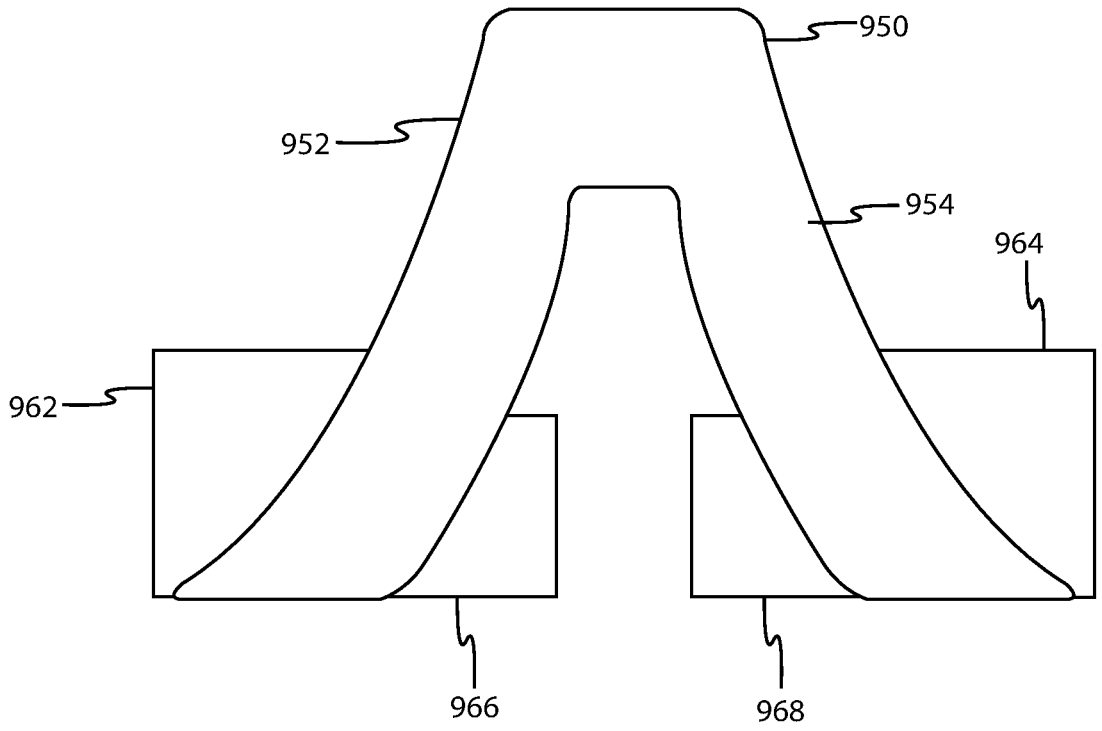
FIG. 10C shoes a front elevational view of still another alternative exemplary embodiment of a projectile for use with any disclosed embodiment of the launcher/retrieval device according to the present invention.

FIG. 10C shows still another alternative exemplary embodiment of a projectile 950 according to the present invention. Projectile 950 is similar in construction to projectile 150, with the exception that projectile 950 includes at least one of fins 962-968 that extend from either or both of legs 952, 954. Fins 962, 964 extend outwardly away from the other of leg 952, 954, while fins 966, 968 extend inwardly toward the other of leg 952, 954. Fins 962-968 can act as rudders and can be bent outwardly from the plane of the paper of FIG. 10C so that fins 962-968 can "steer" projectile 950 in a curved direction away from a plane of launch during flight.

Optionally, each of projectile 150-950 can have flexible arms that . . . .

Optionally, any one of the launcher/retrieval devices and/or projectiles disclosed in this application can be provided with a lighting source, such as a luminescent coating, on at least part of launcher/retrieval device and/or projectile to enable launcher/retrieval device and/or projectile to be seen in the dark.

Still alternatively, passages and/or channels can be provided in any launcher/retrieval device, such as, for example, along the length of handle 110 and/or head 120 to allow for the removable insertion of a light source, such as a glow stick. Further, passage and/or channels can also be provided in any projectile, such as, for example, along the length of arms 154, 156 to allow for the removable insertion of a glow stick. The use of glow sticks with the present invention allows the present invention to be used in the dark. The removability of glow sticks allows used close sticks to be removed while allowing new glow sticks to be inserted into launcher/retrieval device and/or projectile.

Figure 13:
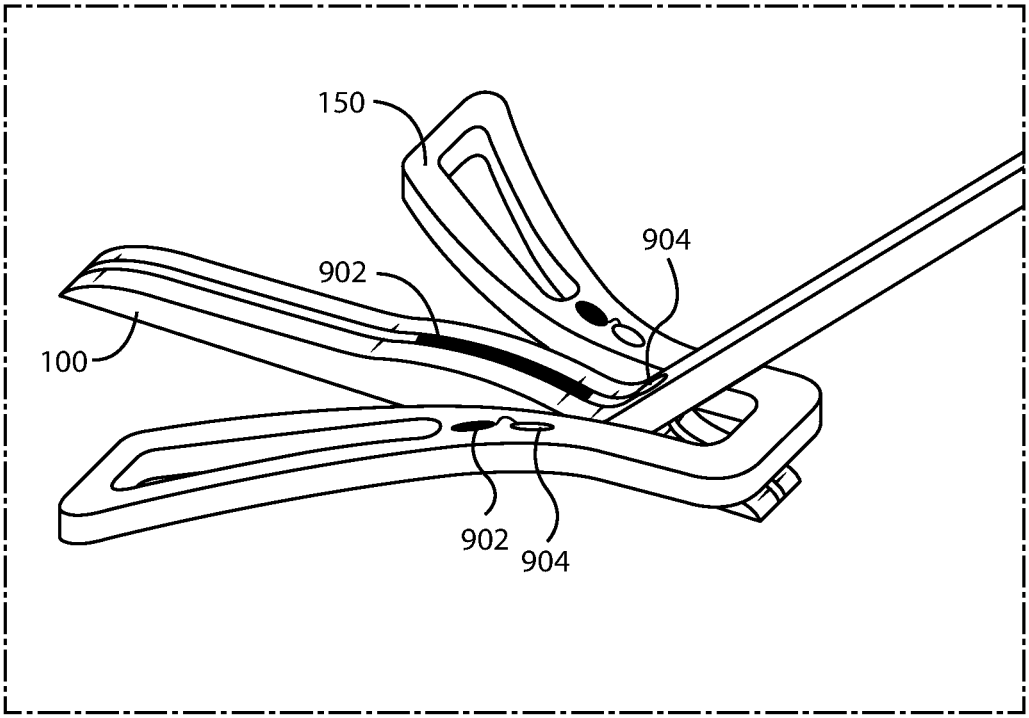
FIG. 13 shows a side elevational view of a launcher/retrieval device according to an exemplary embodiment of the invention, using an electrically powered light to illuminate the device.

While glow sticks can be used to light up launcher/retrieval device 100 and/or projectile 150, those skilled in the art will recognize that other light sources, such as, for example, LED lights 902, as shown in FIG. 13 can be used. LED lights 902 are powered by a battery 904 or other power source located in launcher/retrieval device 100 and/or projectile 150.

Figure 11:
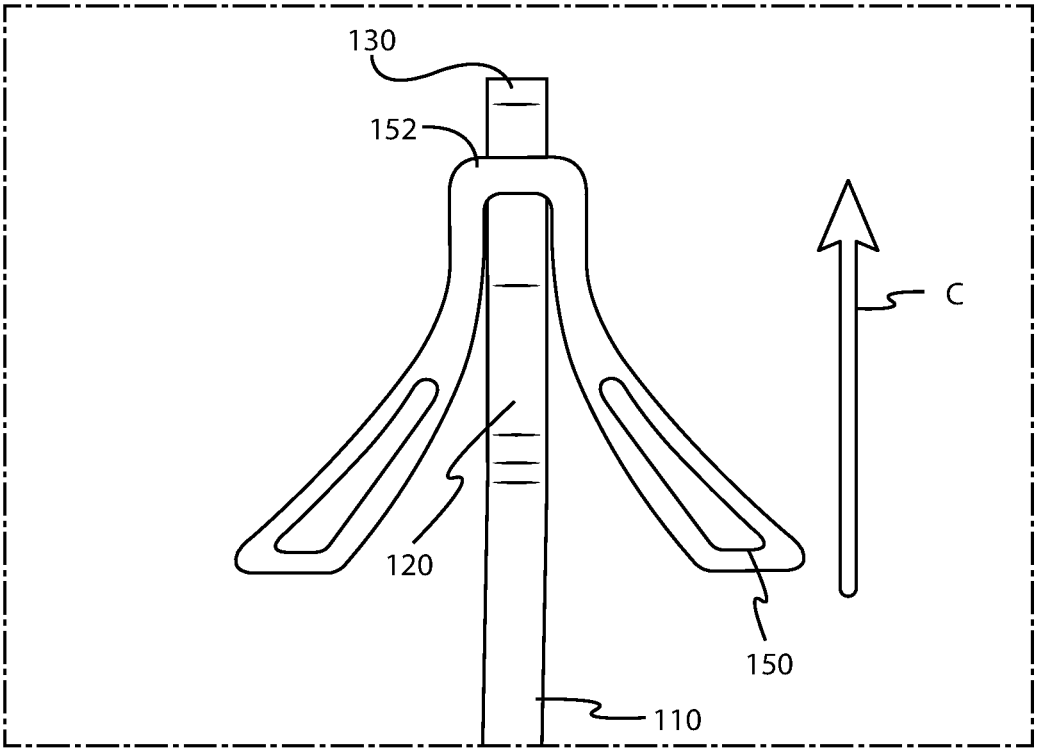
FIG. 11 shows a top plan view of a first method of using the launcher/retrieval device according to any exemplary embodiment of the present invention to pick up any of the projectiles according to the exemplary embodiments of the present invention.

FIG. 11 shows an exemplary method of picking a projectile 150 with launcher/retrieval device 100. First free end 124 is slid underneath apex 152 in the direction of arrow C such that upward end 130 of free end 124 to lift apex 152 and allows head 120 to slide underneath apex 152. Projectile 150 is retained on head 120 in concave receiver 134 between hump 132 and bottom end 114 of handle 110.

Figure 12:
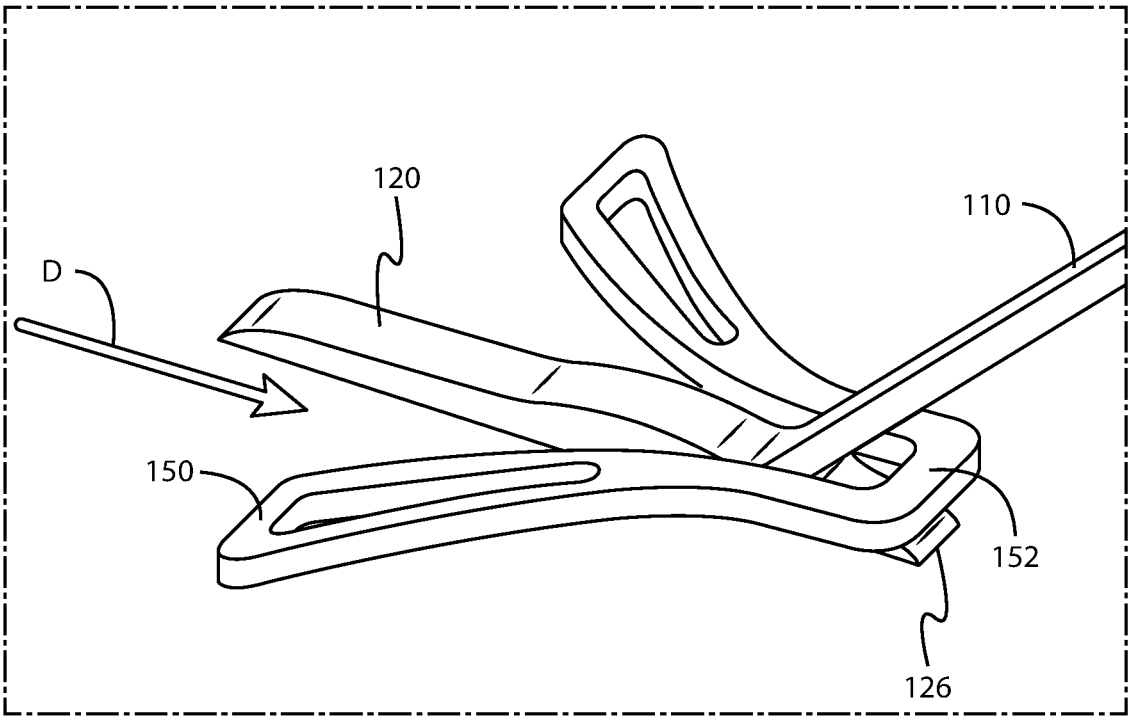
FIG. 12 shows a top plan view of a second method of using the launcher/retrieval device according to any exemplary embodiment of the present invention to pick up any of the projectiles according to the exemplary embodiments of the present invention.

FIG. 12 shows an exemplary embodiment of an alternative method of picking up projectile 150. A second free end 126 is slid underneath apex 152 in the direction of arrow D until apex 152 engages bottom end 114 of handle 110. Projectile 150 is lifted off of the surface by handle 110, and the longitudinal axis of handle 110 is rotated such that apex 152 ends up in concave receiver 134 between hump 132 and bottom end 114 of handle 110.

All of the exemplary embodiments of the launcher/retrieval device and the projectile are each constructed from a rigid material. An exemplary material can be a polymer, such as, for example, ultrahigh molecular weight (UHMW) polymer, although those skilled in the art will recognize that other materials can be used. Optionally, the apex of each projectile can include a magnet or a magnetically attractive material, while the concave receiver in each launcher/retrieval device can include the other of the magnet or magnetically attractive material, such that, when the projectile is being caught with handle 110, the projectile will more naturally gravitate toward the concave receiver.

With projectile 150 nestled in receiver 134, a user can use handle 110 to launch projectile 150 far away from the user, such as, for example, to another user with another handle 110, for the other user to catch projectile 150 with handle 110 or, alternatively, an animal, such as a dog, to chase projectile 150 and retrieve projectile 150.

In an alternative method, the user can merely flip projectile 150 into the air proximate to the user and then catch projectile 150 with handle 110.

Figure 14A:
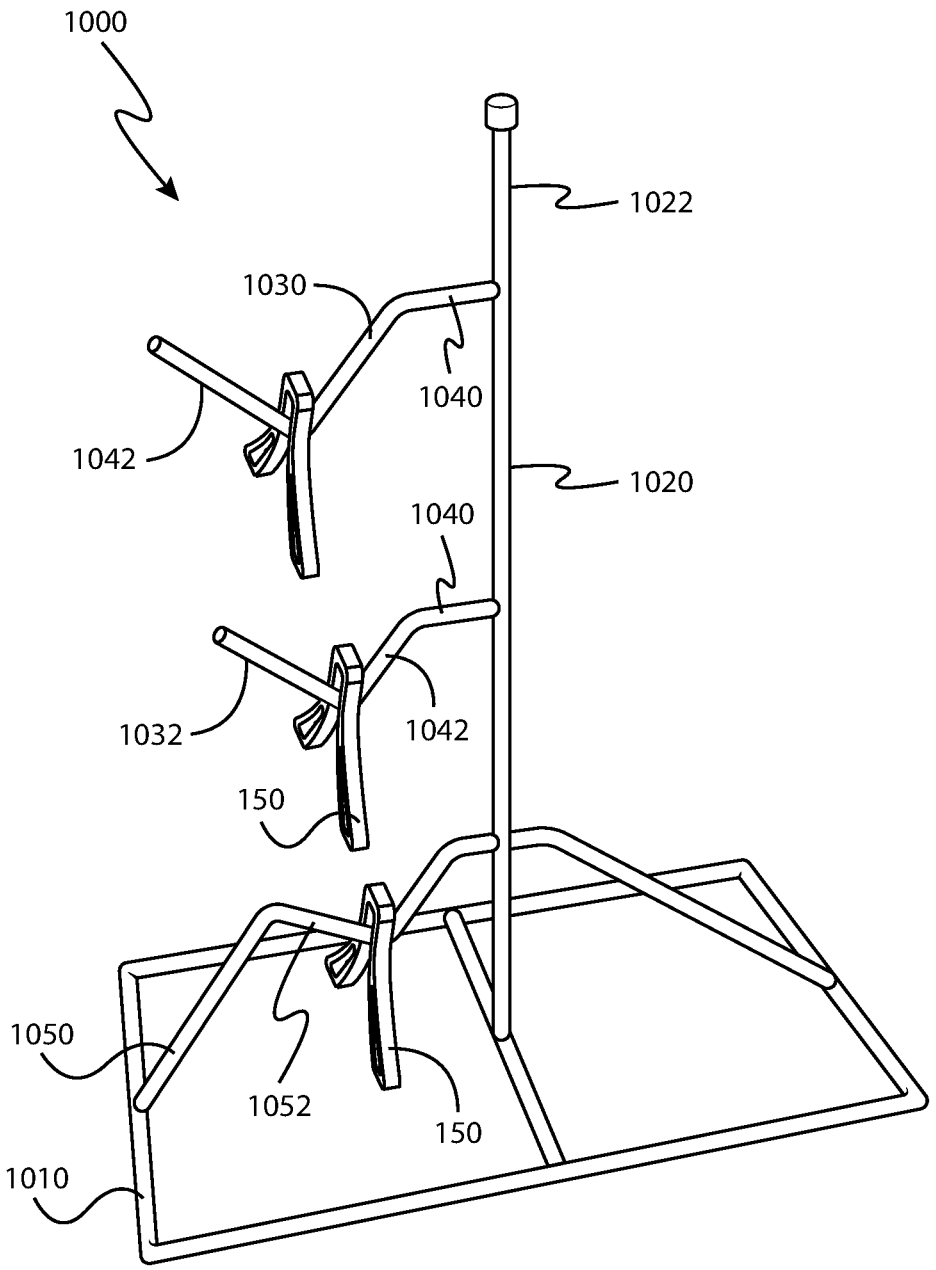
FIG. 14A is a right side perspective view of a frame that is used to catch projectiles according to an exemplary embodiment of the present invention.
Figure 14B:
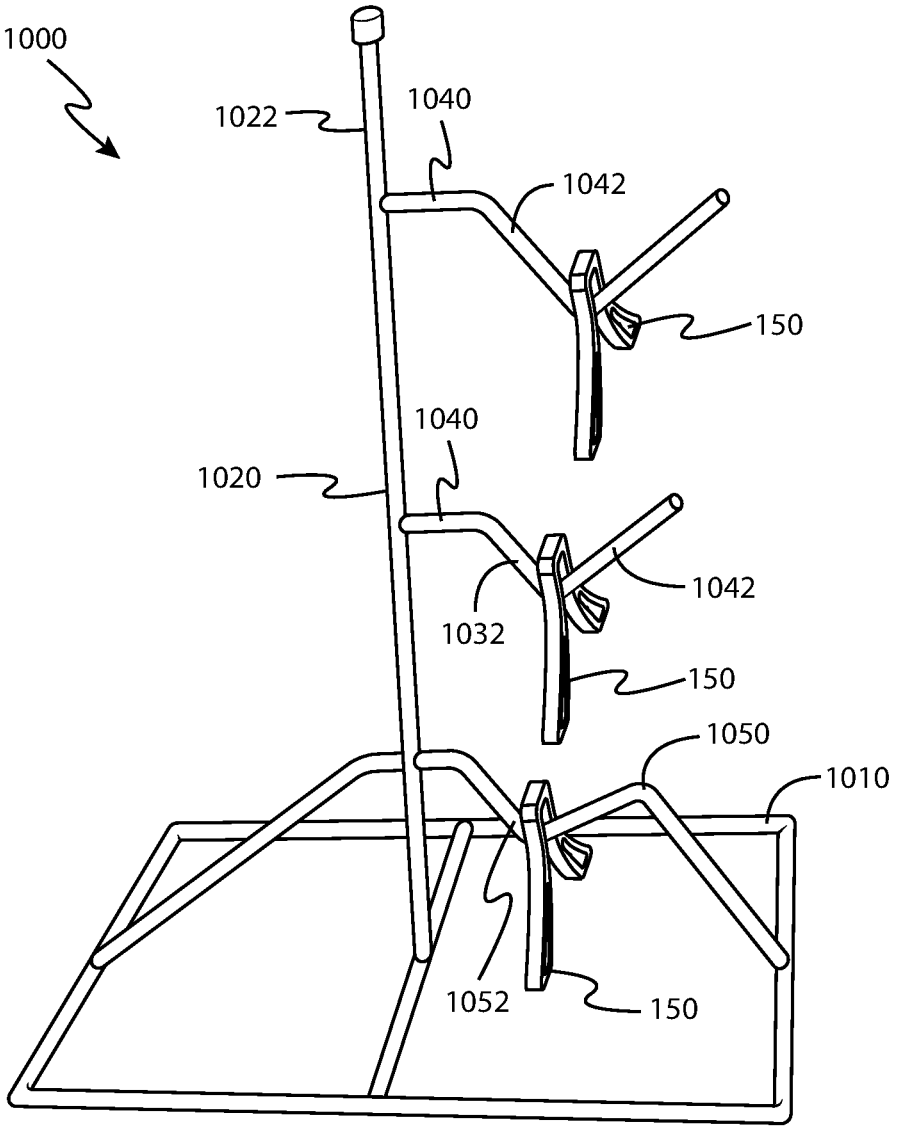
FIG. 14B is a left side perspective view of the frame shown in FIG. 14A.

Any embodiment of launcher/retrieval device 100 using any disclosed launcher and/or projectile can be used to play a game similar to the known game of "Ladderball". Referring to FIGS. 14A and 14B, a frame 1001 can be provided that is used to "catch" a projectile 150-950 after being launched by launcher/retrieval device 110. Frame 1001 can include a generally rectangular base 1010 that is placed on ground G. Although a generally rectangular base 1010 is shown, those skilled in the art will recognize that base 1010 can be generally any shape.

A tower 1020 extends upwardly from base 1010. Tower 1020 includes vertical support 1022 and a plurality of arms 1030, 1032 that extend outwardly from vertical support 1022. Arms 1030, 1032 are coplanar and extend generally in a plane that is coplanar with a plane of flight of a projectile 150-950 that is launched at tower 1020. While two arms 1030, 1032 are shown, those skilled in the art will recognize that more or less than two arms 1030, 1032 can be provided.

Each arm 1030, 1032 includes a connected portion 1040 that extends generally orthogonal to vertical support 1022. A generally "V-shaped" receiver 1042 extends outwardly from connected portion 1040 such that a projectile 150-950 can be "caught" in the crux of the "V", as shown in FIGS. 14A and 14B.

Optionally, a stabilizer 1050 can extend outwardly from vertical support 1022 and connect to a forward portion of base 1010. A generally "V-shaped" receiver 1052 can be formed in stabilizer 1050 such that a projectile 150-950 can be "caught" in the crux of the "V", as is also shown in FIGS. 114A and 14B.

Figure 15:
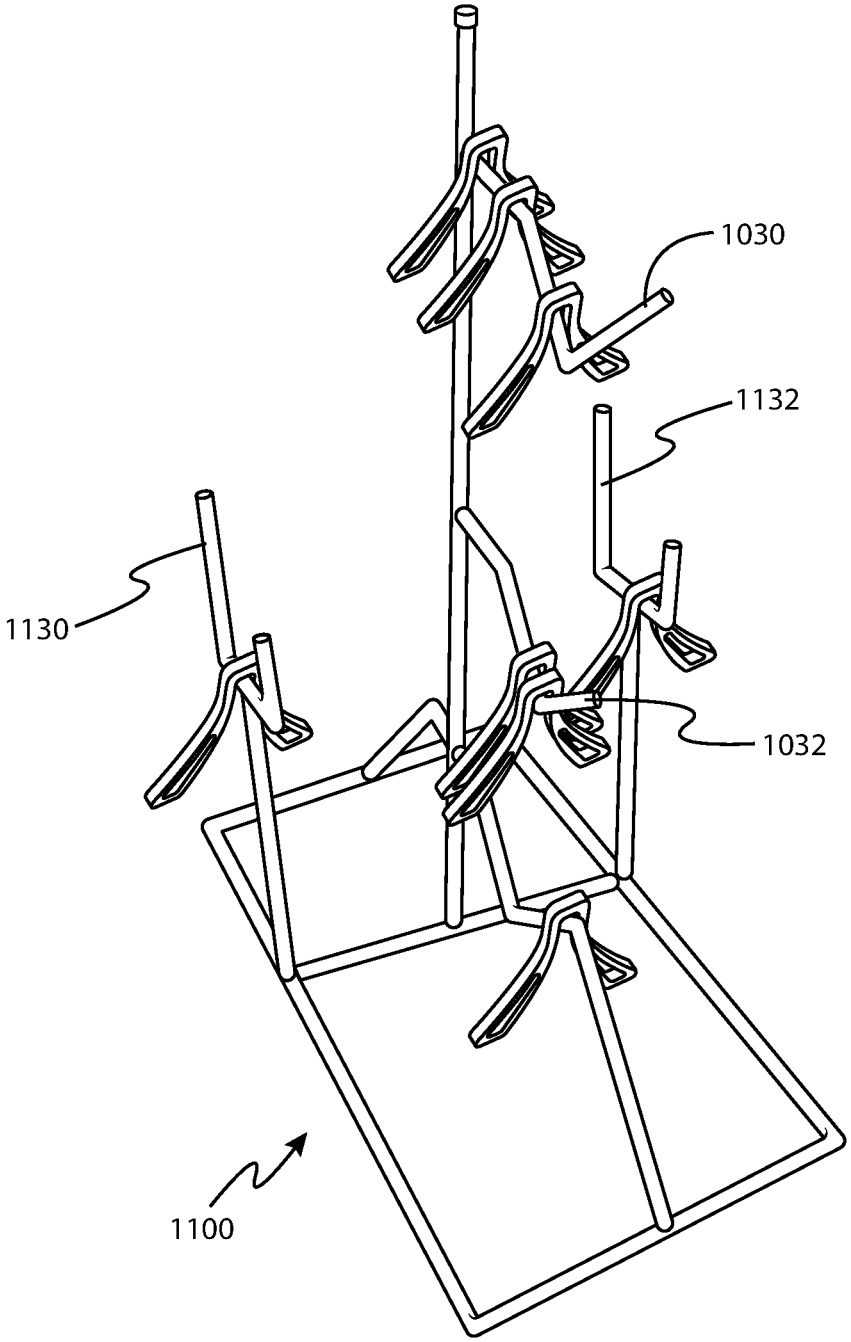
FIG. 15 is a left side perspective view of a frame that is used to catch projectiles according to another exemplary embodiment of the present invention.
Figure 16:
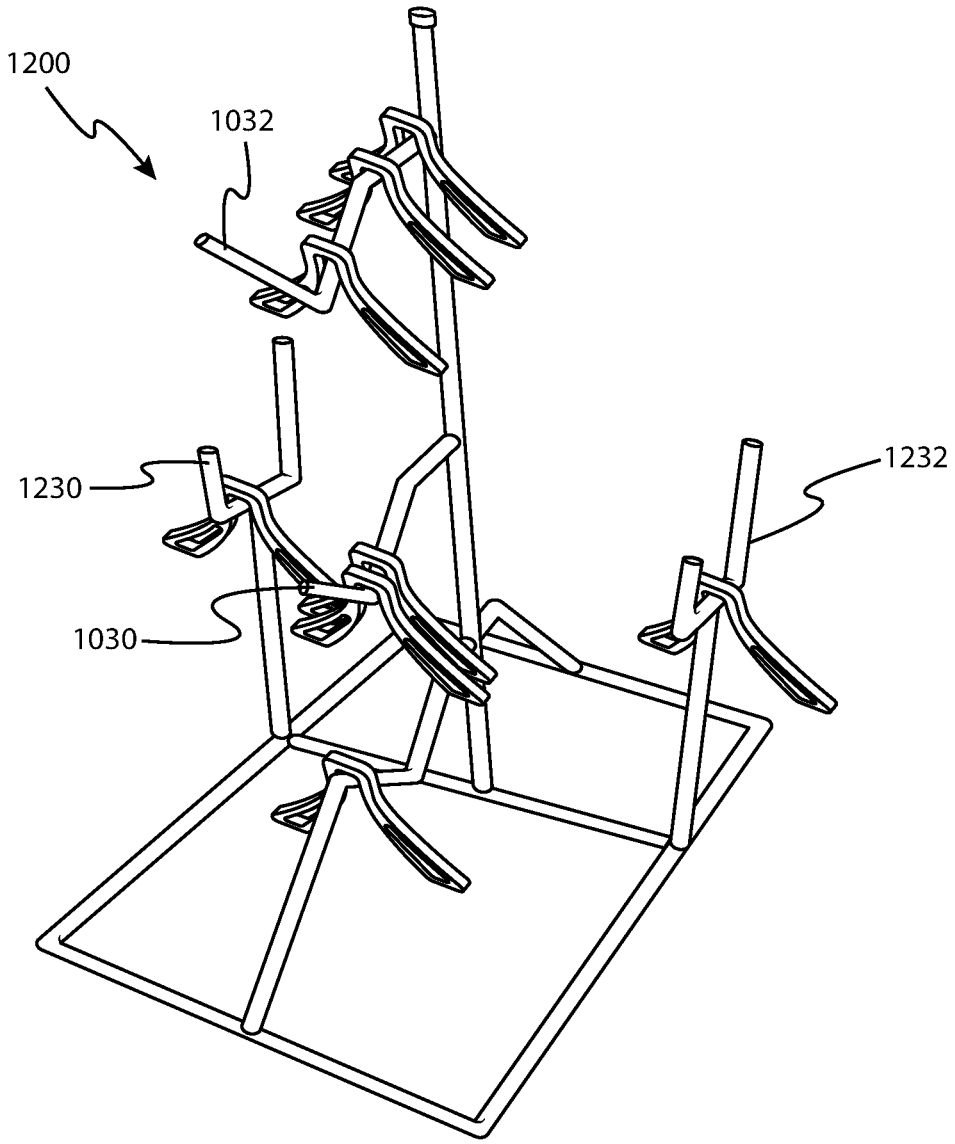
FIG. 16 is a right side perspective view of a frame that is used to catch projectiles according to still another exemplary embodiment of the present invention.

Referring to FIGS. 15 and 16, other configurations of frames 1100, 1200, respectively, can be provided that can be used to "catch" projectiles 150-950 in a manner similar to frame 1001. Each of frame 1100, 1200 is similar to frame 1001, but frames 1100, 1200 each also has arms 1130, 1132 and 1230, 1232, respectively, that have generally "U-shaped" receivers, such that each receiver 1130, 1132, 1230, 1232 extends in its own plane, generally parallel to the plane of arms 1030, 1032. While two alternate embodiments of frames 1100, 1200 are shown, those skilled in the art will recognize that other combinations and configurations of frames can be used.

With respect to any of frames 1001, 1100, 1200, points can be awarded for each successful "catch" of a projectile on a receiver, with different receivers being worth different point values.

Figure 17:
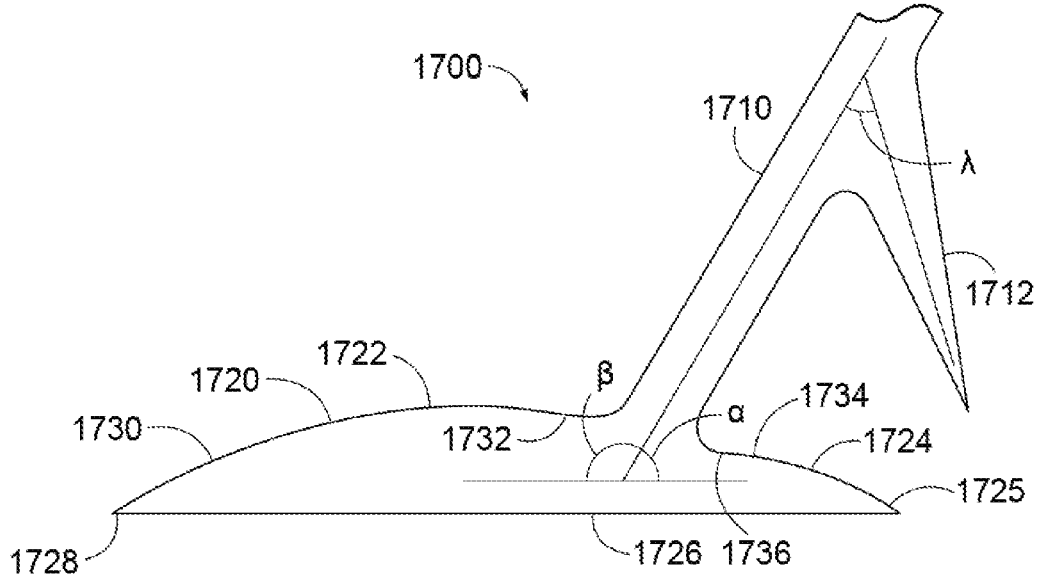
FIG. 17 is a side elevational view of a head end of a launcher/retrieval device according to an alternative embodiment of the present invention.

An alternative embodiment of a head end of a launcher/retrieval device 1700 is shown in FIG. 17. Device 1700 includes a handle 1710 connected to a head 1720. Handle 1710 can include a hook 1712 that extends downwardly at an acute angle λ relative to a length of handle 1710. Hook 1712 can be located proximate to head 1720. Hook 1712 can be used to prevent a user from inadvertently flipping a projectile along the back of handle 1710, and possibly hitting and injuring himself/herself in the process. Optionally, hook 1712 can be omitted in its entirety.

Head 1720 includes a first head end 1722 that extends at an obtuse angle β relative to the length of handle 1710 and a second head end 1724 that extends at an acute angle α relative to the length of handle 1710. Second head end 1724 is shorter than first head end 1722 and has a second end tip 1725 that terminates within a footprint of hook 1712.

First head end 1722 and second head end 1724 are co-planar and have a common, generally flat bottom surface 1726 extending between second end tip 1725 and a first end tip 1728. First head end 1722 has a top surface 1730 that is convex in shape between first end tip 1725 and an inflection point 1732 proximate to handle 1710. Inflection point 1732 changes the curve of top surface 1730 from convex to concave between inflection point 1732 and handle 1710.

Second head end 1724 has a top surface 1734 that is convex in shape between second end tip 1725 and an inflection point 1736 proximate to handle 1710. Inflection point 1736 changes the curve of top surface 1734 from convex to concave between inflection point 1736 and handle 1710.

The concave part of top surface 1730 proximate to handle 1710 provides a receiver for projectile 150 to rest in prior to launching projectile 150.

Figure 18:
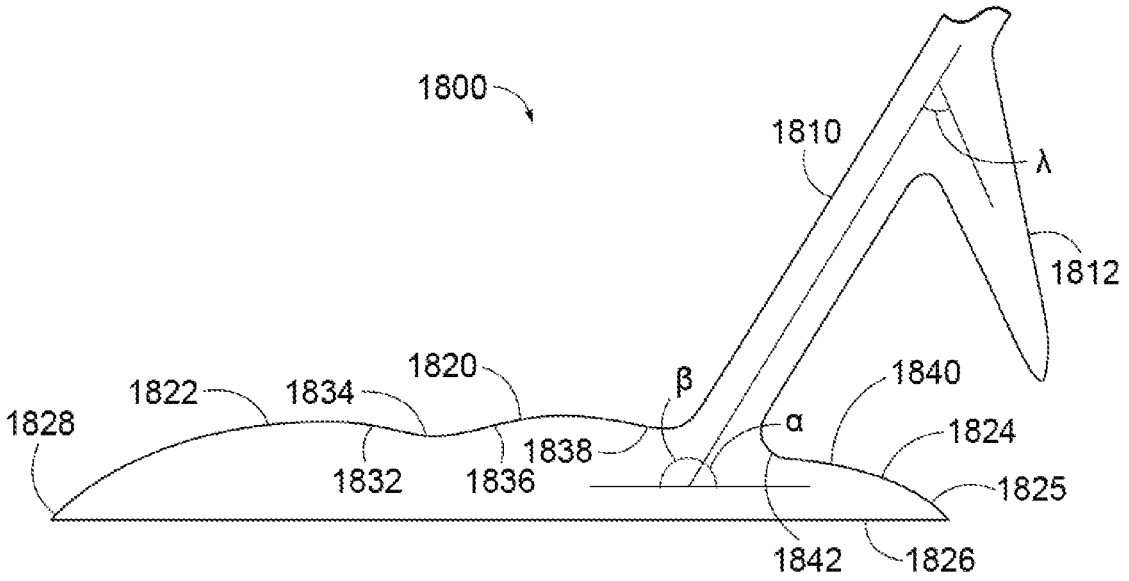
FIG. 18 is a side elevational view of another head end of a launcher/retrieval device according to an alternative embodiment of the present invention.

Another alternative embodiment of a head end of a launcher/retrieval device 1800 is shown in FIG. 18. Device 1800 includes a handle 1810 connected to a head 1820. Handle 1810 can include a hook 1812 that extends downwardly at an acute angle λ relative to a length of handle 1810. Hook 1812 can be located proximate to head 1820. Optionally, hook 1812 can be omitted in its entirety.

Head 1820 includes a first head end 1822 that extends at an obtuse angle β relative to the length of handle 1810 and a second head end 1824 that extends at an acute angle α relative to the length of handle 1810. Second head end 1824 is shorter than first head end 1822 and has a second end tip 1825 that terminates within a footprint of hook 1812.

First head end 1822 and second head end 1824 are co-planar and have a common, generally flat bottom surface 1826 extending between second end tip 1825 and a first end tip 1828. First head end 1822 has a top surface 1830 that is convex in shape between first end tip 1825 and a first inflection point 1832. Top surface 1830 transitions to a concave shape 1834 between first inflection point and a second inflection point 1836. Top surface then transitions to a second convex shape between second inflection point 1836 and a third inflection point 1838. Third inflection point 1838 changes the curve of top surface 1830 from convex to concave between inflection point 1838 and handle 1810.

Second head end 1824 has a top surface 1840 that is convex in shape between second end tip 1825 and an inflection point 1842 proximate to handle 1810. Inflection point 1842 changes the curve of top surface 1842 from convex to concave between inflection point 1842 and handle 1810.

The contour of top surface 1830 allows projectile 150 to rest in concave shape 1834 to allow for shorter throws of projectile 150 and the concave shape between inflection point 1838 and handle 1810 allows for longer throws of projectile 150.

Figure 19:
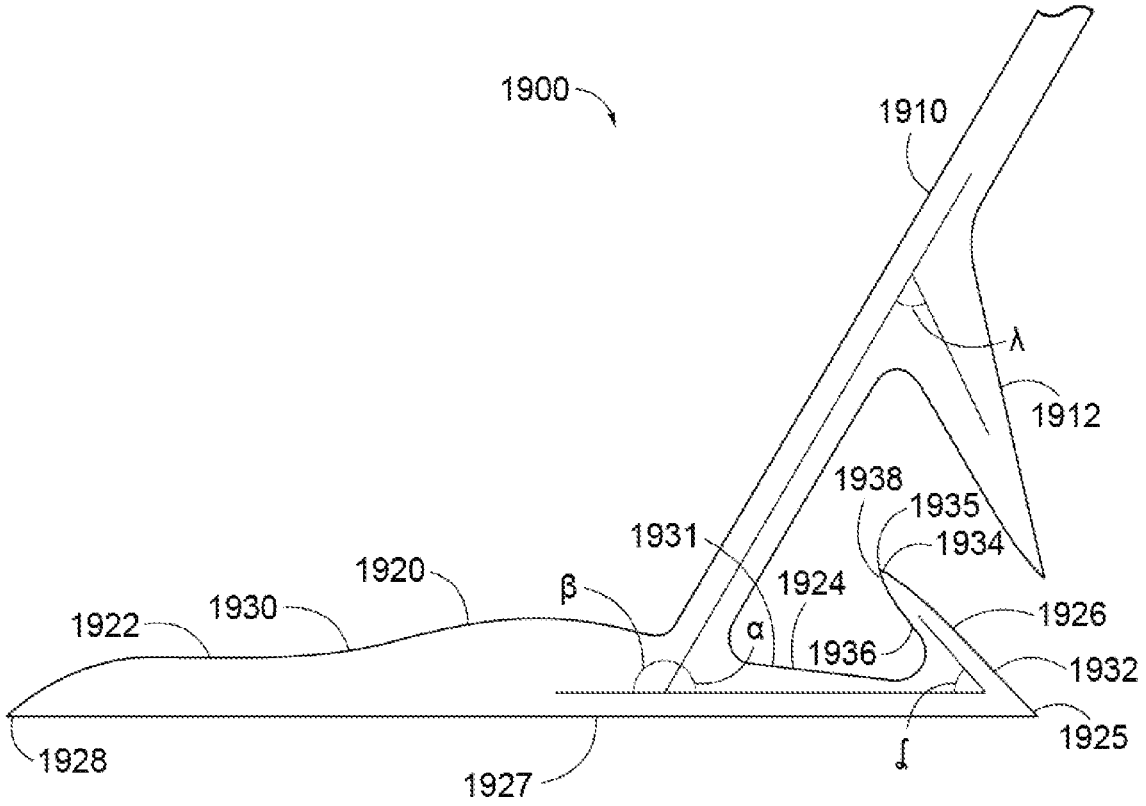
FIG. 19 is a side elevational view of another head end of a launcher/retrieval device according to an alternative embodiment of the present invention.

Another alternative embodiment of a head end of a launcher/retrieval device 1900 is shown in FIG. 19. Device 1900 includes a handle 1910 connected to a head 1920. Handle 1910 can include a hook 1912 that extends downwardly at an acute angle λ relative to a length of handle 1910. Hook 1912 can be located proximate to head 1920. Optionally, hook 1912 can be omitted in its entirety.

Head 1920 includes a first head end 1922 that extends at an obtuse angle β relative to the length of handle 1910 and a second head end 1924 that extends at an acute angle α relative to the length of handle 1910. Second head end 1924 is shorter than first head end 1922 and has a second end tip 1925 that terminates in a reverse hook 1926 that extends upwardly toward handle 1910 at an acute angle δ relative to a horizontal axis of head 1920.

First head end 1922 and second head end 1924 are co-planar and have a common, generally flat bottom surface 1927 extending between second end tip 1925 and a first end tip 1928. First head end 1922 has a top surface 1930 that shown as similar to the top surface of device 100, although those skilled in the art will recognize that top surface 1930 can be any contour disclosed herein.

Second head end 1924 has a top surface 1931 that is generally flat. Reverse hook 1926 includes a generally planar exterior surface 1932 extending between second tip end 1925 and hook end 1934. Hook end 1934 has a generally pointed tip 1935. An interior surface 1936 of hook 1926 has a generally concave shape at second head end 1924 and a generally planar surface 1938 proximate to hook end tip 1935.

Reverse hook 1926 prevents projectile 150 from inadvertently being flipped upward toward the user when the user is performing tricks with projectile 150 on the back of handle 1910.

Figure 20:
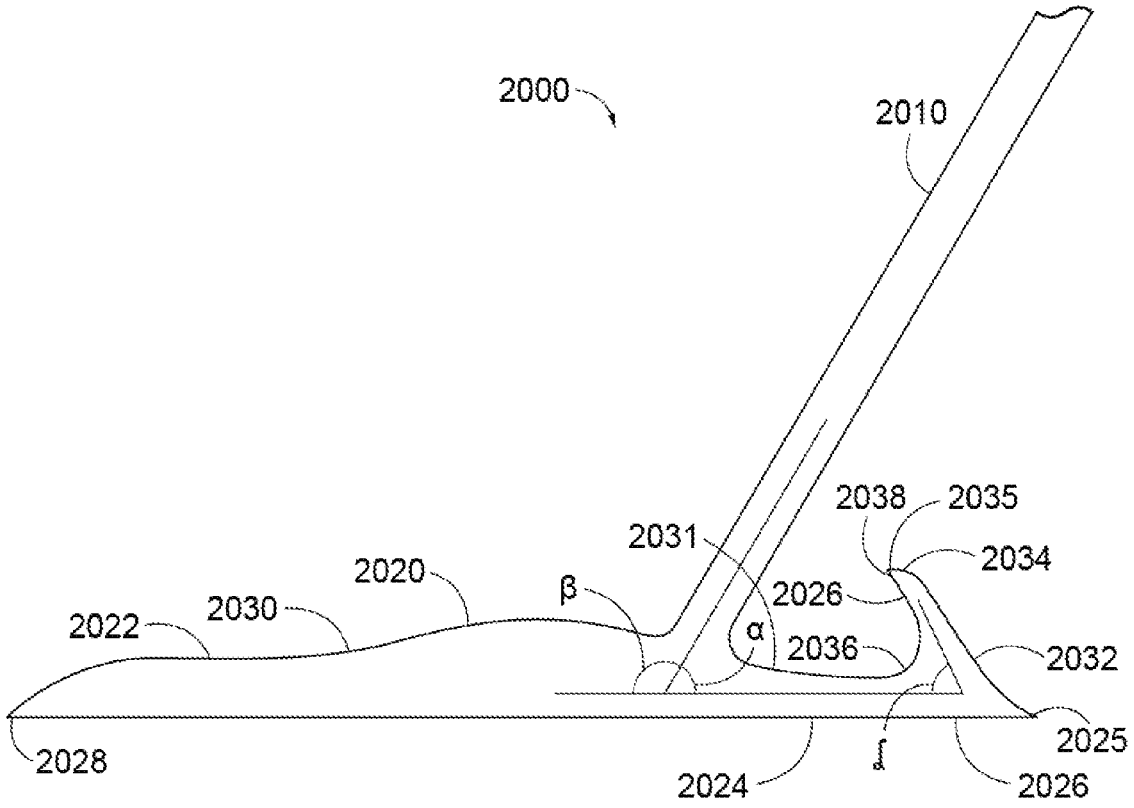
FIG. 20 is a side elevational view of another head end of a launcher/retrieval device according to an alternative embodiment of the present invention.

Another alternative embodiment of a head end of a launcher/retrieval device 2000 is shown in FIG. 20. Device 2000 includes a handle 2010 connected to a head 2020. Handle 2010 can be provided with or without a hook, such as hook 1912 shown in FIG. 19.

Head 2020 includes a first head end 2022 that extends at an obtuse angle β relative to the length of handle 2010 and a second head end 2024 that extends at an acute angle α relative to the length of handle 2010. Second head end 2024 is shorter than first head end 2022 and has a second end tip 2025 that terminates in a reverse hook 2026 that extends upwardly toward handle 2010 at an acute angle δ relative to a horizontal axis of head 2020.

First head end 2022 and second head end 2024 are co-planar and have a common, generally flat bottom surface 2026 extending between second end tip 2025 and a first end tip 2028. First head end 2022 has a top surface 2030 that shown as similar to the top surface of device 100, although those skilled in the art will recognize that top surface 2030 can be any contour disclosed herein.

Second head end 2024 has a top surface 2031 that is generally flat. Reverse hook 2026 includes a generally planar exterior surface 2032 extending between second tip end 2025 toward a hook end 2034. Hook end 2034 has a generally convex curved tip 2035. An interior surface 2036 of hook 2026 has a generally concave shape at second head end 2024 and a generally planar surface 2038 proximate to hook end tip 2035.

Reverse hook 2026 prevents projectile 150 from inadvertently being flipped upward toward the user when the user is performing tricks with projectile 150 on the back of handle 2010.

Figure 21:
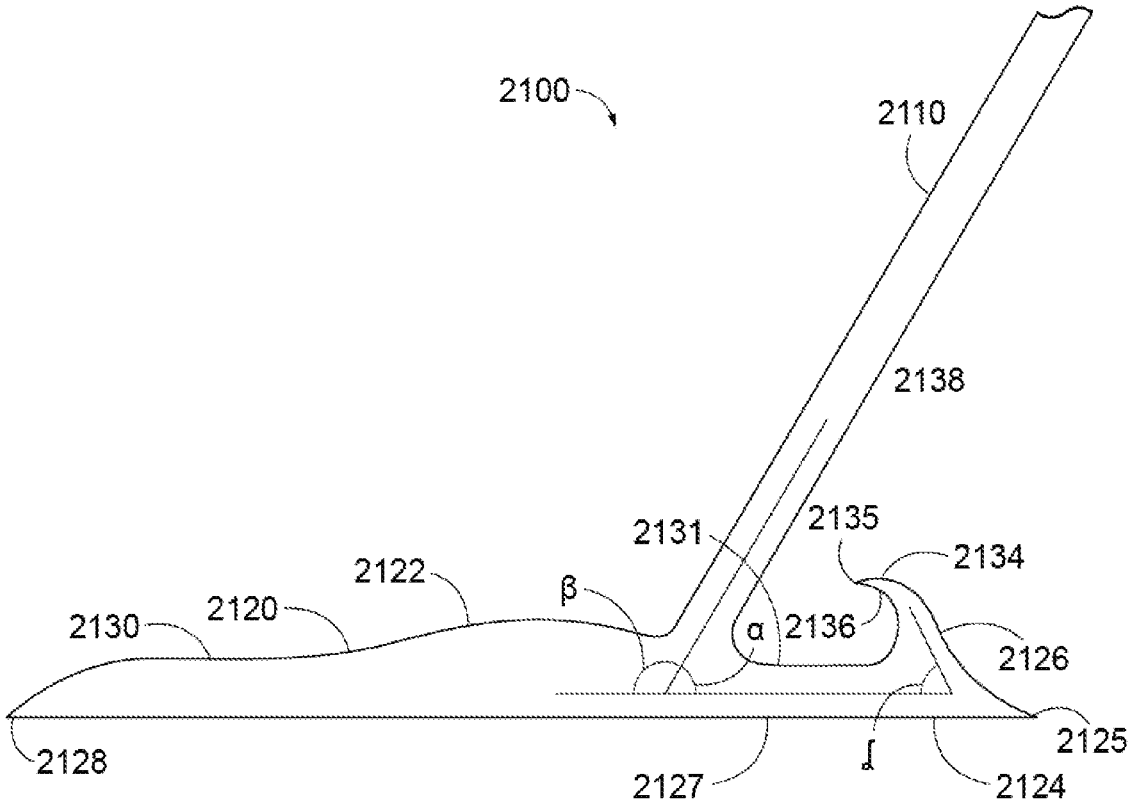
FIG. 21 is a side elevational view of another head end of a launcher/retrieval device according to an alternative embodiment of the present invention.

Another alternative embodiment of a head end of a launcher/retrieval device 2100 is shown in FIG. 21. Device 2100 includes a handle 2110 connected to a head 2120. Handle 2110 can be provided with or without a hook, such as hook 1912 shown in FIG. 19.

Head 2120 includes a first head end 2122 that extends at an obtuse angle β relative to the length of handle 2110 and a second head end 2124 that extends at an acute angle α relative to the length of handle 2110. Second head end 2124 is shorter than first head end 2122 and has a second end tip 2125 that terminates in a reverse hook 2126 that extends upwardly toward handle 2110 at an acute angle δ relative to a horizontal axis of head 2120.

First head end 2122 and second head end 2124 are co-planar and have a common, generally flat bottom surface 2127 extending between second end tip 2125 and a first end tip 2128. First head end 2122 has a top surface 2130 that shown as similar to the top surface of device 100, although those skilled in the art will recognize that top surface 2130 can be any contour disclosed herein.

Second head end 2124 has a top surface 2131 that is generally flat. Reverse hook 2126 includes a generally planar exterior surface 2132 extending between second tip end 2125 toward a hook end 2134. Hook end 2134 has a generally convex curved tip 2135. An interior surface 2136 of hook 2126 has a generally concave shape between second head end 2124 and hook end tip 2135 such that reverse hook 2126 has a generally wave-like profile.

Reverse hook 2126 prevents projectile 150 from inadvertently being flipped upward toward the user when the user is performing tricks with projectile 150 on the back of handle 2110.

Figure 22:
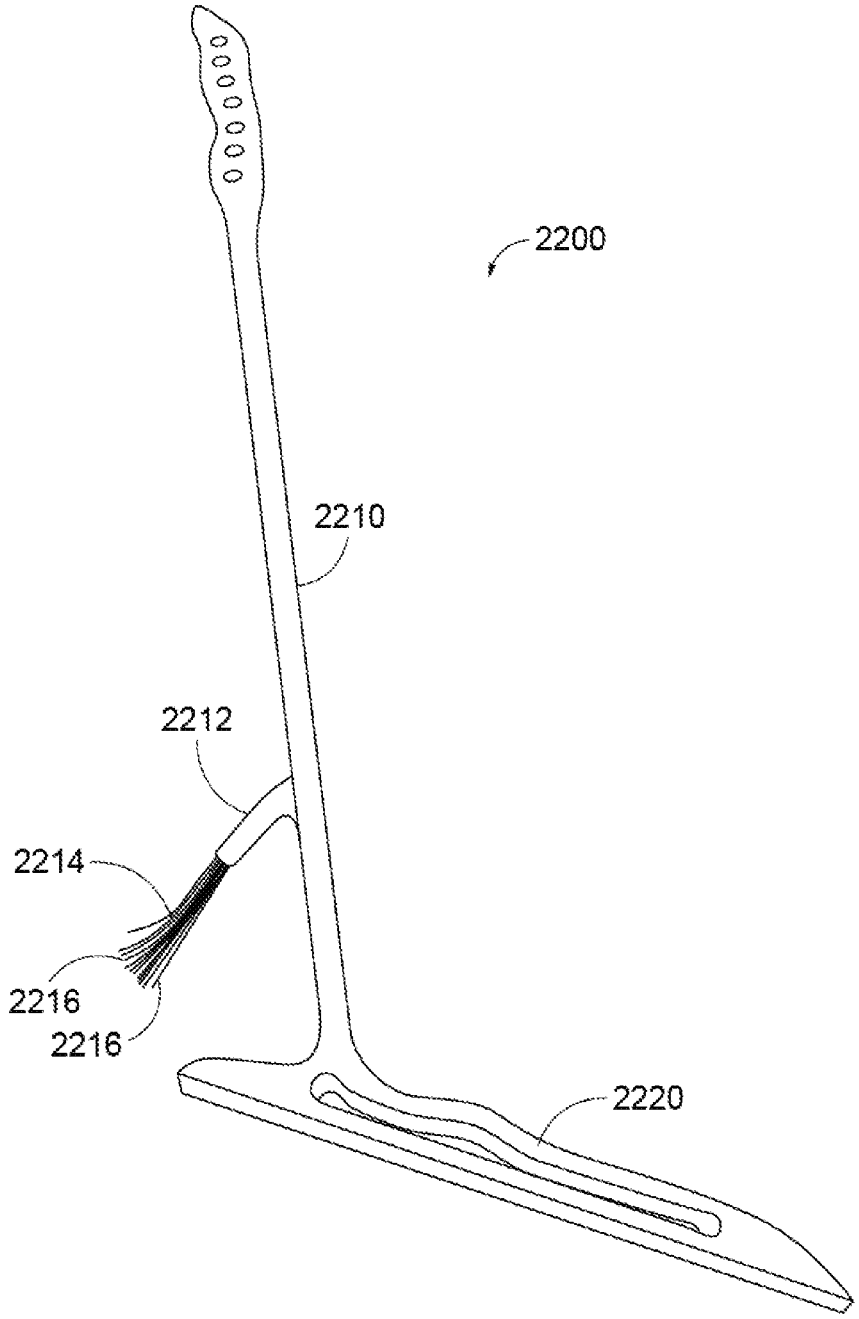
FIG. 22 is a bottom perspective view of a launcher/retrieval device according to an alternative embodiment of the present invention.

An alternative embodiment of a launcher/retrieval device 2200 is shown in FIG. 22. Device 2200 can have a head end 2220 that is similar to any other launcher/retrieval device disclosed herein.

Device 2200 includes a handle 2210 connected to head 2220. Handle 2210 can include a hook 2212 that is flexible enough to deflect toward or away from handle 2210 Hook 2212 can be located proximate to head 2220 and can be constructed from a low density polymer. Alternatively, a distal end 2214 can be constructed from a plurality of polymer strands 2216 that form a "brush".

Hook 2212 can be used as a deterrent to discourage a user from trying to flip projectile 150 from the back side of handle 2210.

Figure 23:
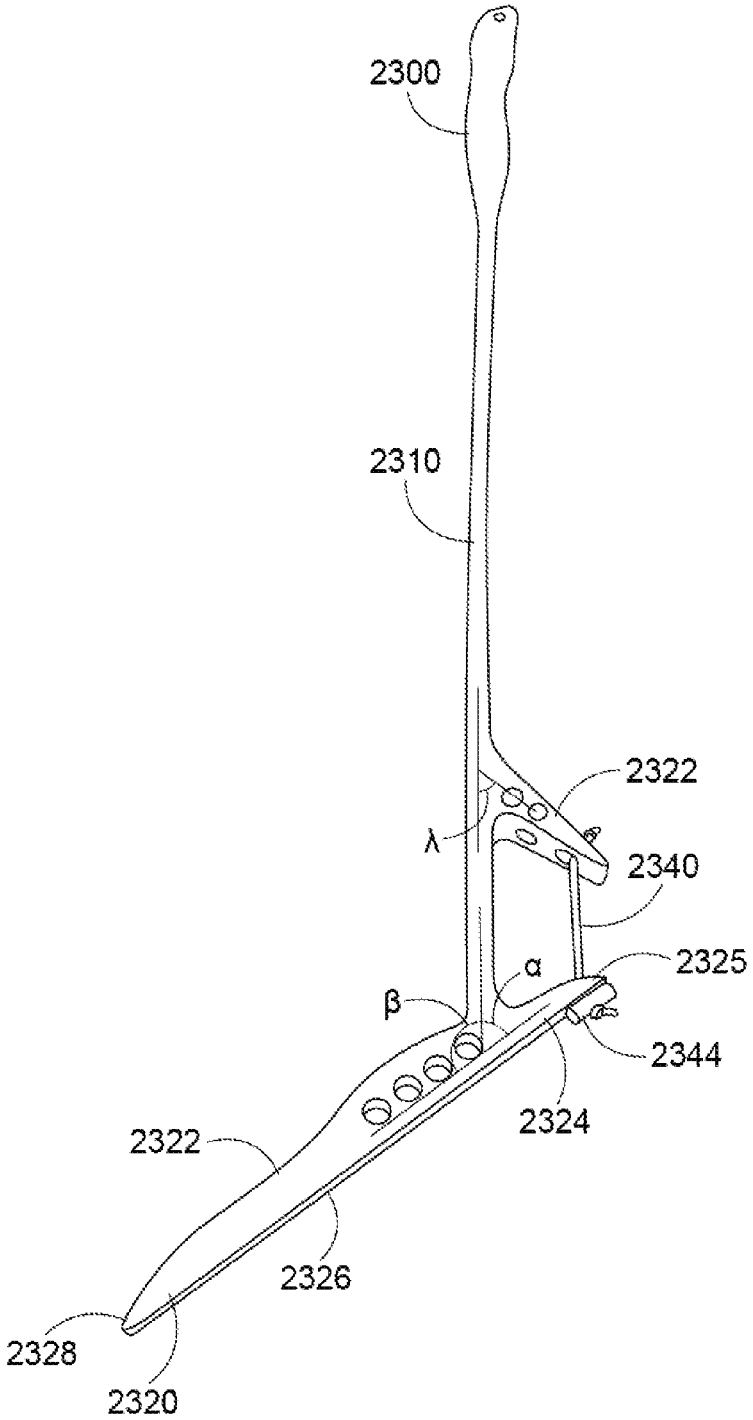
FIG. 23 is a side elevational view of a launcher/retrieval device according to an alternative embodiment of the present invention.
Figure 24:
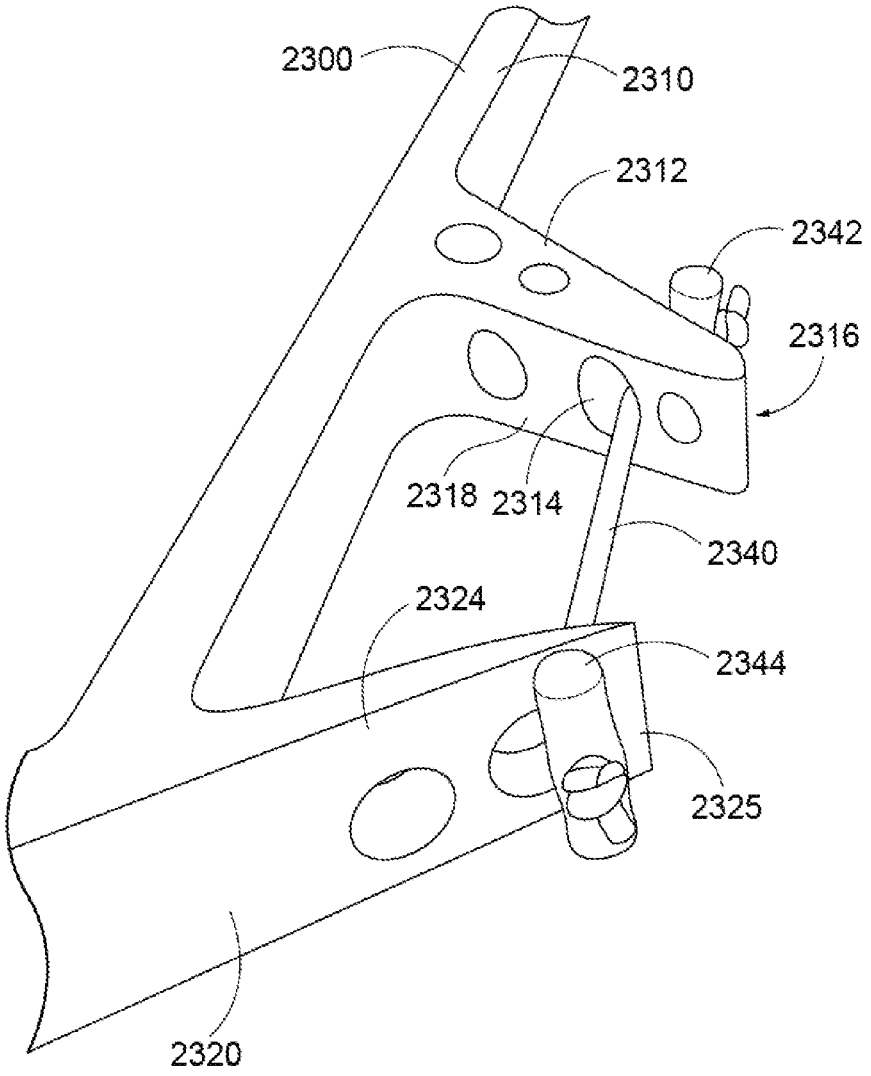
FIG. 24 is an enlarged bottom perspective view of the device of FIG. 23.
Figure 25:
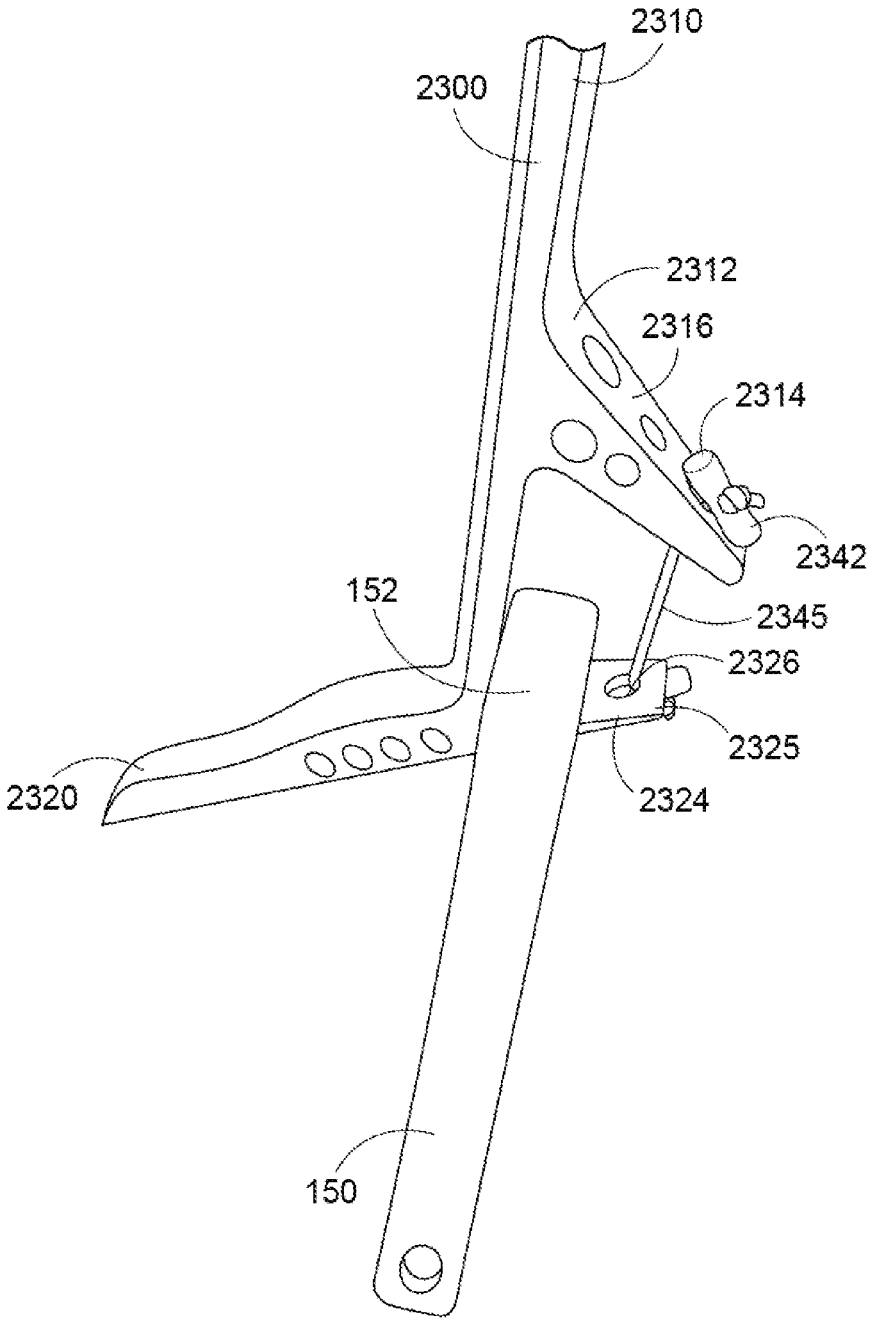
FIG. 25 is a side perspective view of the device of FIG. 23, with a projectile from FIG. 4 resting thereon.

An alternative embodiment of a launcher/retrieval device 2300 is shown in FIGS. 23-25. Device 2300 includes a handle 2310 connected to a head 2320. Handle 2310 includes a hook 2312 that extends downwardly at an acute angle λ relative to a length of handle 2310. Hook 2312 can be located proximate to head 2320.

Hook 2312 includes at least one through opening 2314 that extends between a top surface 2316 and a bottom surface 2318 of hook 2310.

Head 2320 includes a first head end 2322 that extends at an obtuse angle β relative to the length of handle 2310 and a second head end 2324 that extends at an acute angle α relative to the length of handle 2310. Second head end 2324 is shorter than first head end 2322 and has a second end tip 2325 that terminates within a footprint of hook 2312.

First head end 2322 and second head end 2324 are co-planar and have a common, generally flat bottom surface 2326 extending between second end tip 2325 and a first end tip 2328.

Second head end 2324 includes at least one through opening 2326 located between handle 2310 and second end tip 2325. An elastic strap 2340 extends between through opening 2314 and through opening 2326. Strap 2340 includes a first knob 2342 extending from one end of strap 2340 and a second knob 2344 extending from a second end of strap 2340. Knobs 2342, 2344 are generally cylindrical in shape with a diameter smaller than each of through openings 2314, 2326 but with a length longer than the diameter of through openings 2314, 2326.

First knob 2342 can be inserted through opening 2314 and second knob 2344 can be inserted through opening 2326, with strap 2340 extending through the gap between hook 2312 and second end 2324, forming a closed loop between strap 2340, second end 2324, handle 2310, and hook 2312.

As shown in FIG. 25, projectile 150 can be inserted over second end 2324 with apex 152 resting on the top surface of second end 2324 so that strap 2340 prevents projectile 150 from falling off second end 2324 at second end tip 2325. Strap 2340 can be removed from hook 2312 and second end 2324 prior to using device 2300.

Figure 26:
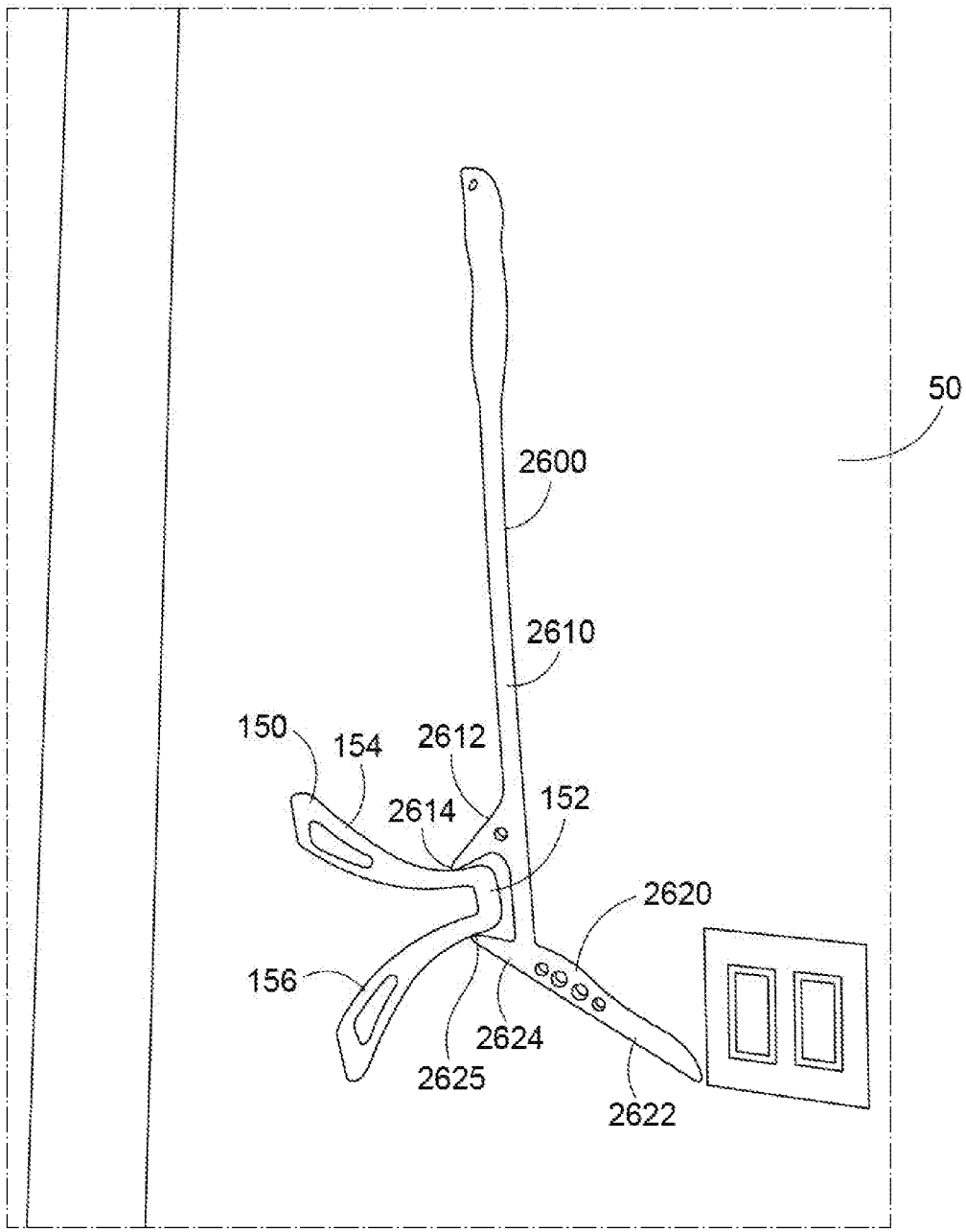
FIG. 26 is a side elevational view of the device of FIG. 25 with the projectile of FIG. 4 connected thereto.
Figure 27:
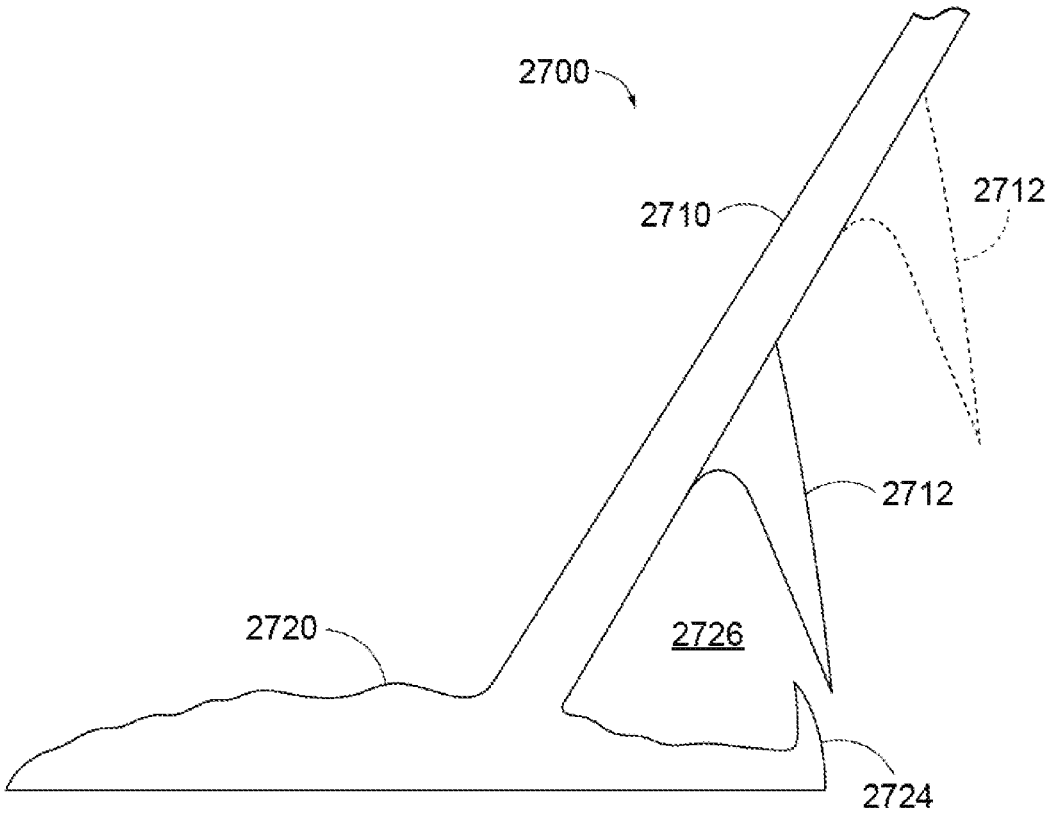
FIG. 27 is a side elevational view of a head end of a launcher/retrieval device according to an alternative embodiment of the present invention.

While projectile 150 can be stored on device 2300 as shown in FIG. 25, device 2300 extends in one plane, while projectile 150 extends in a plane generally orthogonal to that of device 2300. FIG. 26 shows an alternative storage method in which projectile 150 and a device 2600 are in the same plane, allowing both projectile 150 and device 2600 to be stored along a flat surface, such as a wall 50, such that projectile 150 does not extend outwardly from wall 50, away from device 2600.

Device 2600 includes a handle 2610 and a hook 2612 having a hook tip 2614 extending downwardly away from handle 2610. Device 2600 also includes a head 2620 having a first head end 2622 and a second head end 2624, with a second end tip 2625. Apex 152 of projectile 150 fits into a space between hook tip 2614 and second end tip 2625 such that legs 154, 156 of projectile 150 each engage one of hook tip 2614 and second end tip 2625 to support projectile 150 when device 2600 is mounted on a wall.

FIGS. 27-31 show an alternative embodiment of a device 2700 with a handle 2710 having a hook 2712 that can slide up and down a slot 2714 on back side of handle 2710. Hook 2712 can slide down to the position shown in solid lines in FIG. 27 where hook 2712 is proximate to second head end 2724 on head 2720, forming a generally closed space 2726 that can be used to retain projectile 150, and slide up to the position shown in broken lines in FIG. 27 where hook 2712 is distal from second head end 2720.

Figure 28:
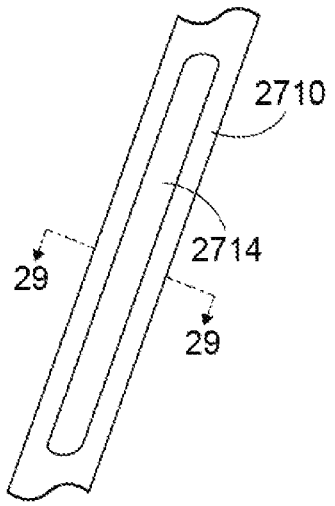
FIG. 28 is a rear elevational view of the handle of the device of FIG. 27.
Figure 29:
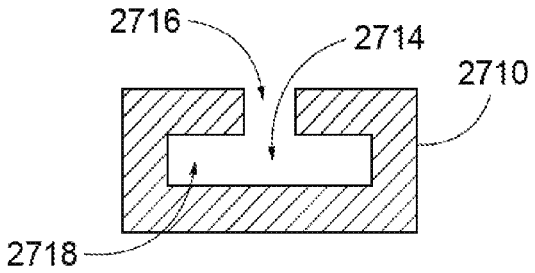
FIG. 29 is a sectional view of the handle of FIG. 28 taken along lines 29-29 of FIG. 28.
Figure 30:
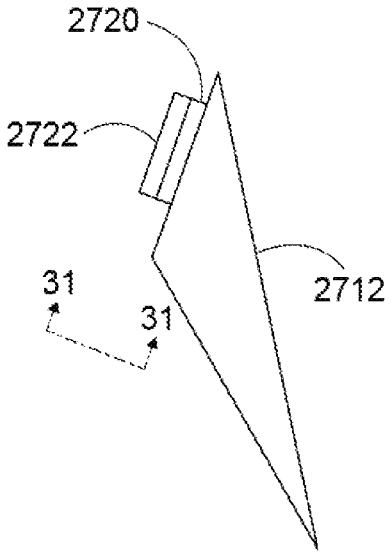
FIG. 30 is a side elevational vie of a hook used with the handle of FIG. 27.
Figure 31:
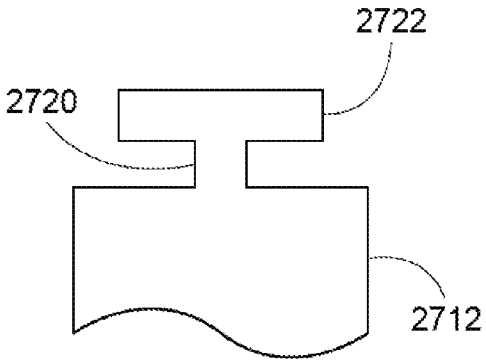
FIG. 31 is a sectional view of the hook of FIG. 30 taken along lines 31-31 of FIG. 30.

Referring to FIGS. 28 and 29, slot 2712 has a generally tee-shaped cross section with a narrow opening 2716 and a wider groove 2718. Referring to FIGS. 30 and 31, hook 2712 has a complementary stem 2720 extending from hook 2712, with a tang 2722 extending from stem 2720. Tang 2722 fits into groove 2718 and stem 2720 fits into opening 2716. In an exemplary embodiment, hook 2712 slides along slot 2712 with close tolerances so that hook 2712 can be slid to a desired length along slot 2712 and released so that hook 2712 remains in that location along slot 2714.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A flip toy launcher comprising:

a launcher having:

an elongate handle having:

a top end; and a bottom end, distal from the top end;

a hook extending downwardly from the handle on a first side of the handle; and a head fixedly attached to the bottom end, the head comprising:

a connector portion connected to the handle;

a first free end portion extending from the connector portion away from the handle; and a second free end portion extending away from the handle, opposite from the first free end portion, wherein the second free end portion comprises a second end tip and a reverse hook extending upwardly from the second end tip toward the handle on the first side of the handle, wherein the head further comprises:

a planar bottom surface extending from a free end of the first free end portion to a free end of the second free end portion; and the first free end portion comprises a top surface, proximate to the handle, the top surface comprising:

a concave receiver located adjacent to the connector portion;

a convex hump adjacent to the concave receiver;

a tip, distal from the connector portion;

a sloped upward portion adjacent to the tip; and a flattened intermediate portion adjacent the generally sloped upward portion and adjacent to the convex hump.

2. The flip toy launcher according to claim 1, wherein the elongate handle has a slot formed therein between the top end and the bottom end, and wherein the hook is slidably inserted into the slot.

3. The flip toy launcher according to claim 2, wherein the downwardly directed hook is slidable along the elongate handle.

4. The flip toy launcher according to claim 1, wherein the reverse hook has a wave-like profile.

5. The flip toy launcher according to claim 1, wherein the hook has a first through opening and the second free end has a second through opening, and wherein the launcher further comprises a strap extending between the first through opening and the second through opening.

6. The flip toy launcher according to claim 1, where in the hook comprises a brush.

7. A flip toy launcher assembly comprising:

a launcher comprising:

an elongate handle having:

a top end; and a bottom end, distal from the top end;

a hook extending downwardly and away from the handle between the top end and the bottom end; and a head fixedly attached to the bottom end, the head comprising:

a connector portion connected to the handle;

a first free end portion extending from the connector portion away from the handle, wherein the head further comprises: a planar bottom surface extending from a free end of the first free end portion to a free end of the second free end portion; and the first free end portion comprises a top surface, the top surface comprising:

a concave receiver located adjacent to the connector portion;

a convex hump adjacent to the concave receiver;

a flattened intermediate portion adjacent to the generally sloped upward portion and adjacent to the convex hump;

a sloped upward portion adjacent to the flattened intermediate portion; and and a second free end portion extending away from the handle, opposite from the first free end portion and shorter than the first free end portion, wherein the second free end comprises second end tip;

and a projectile comprising:

an apex having a first side and a second side;

a first leg extending away from the first side of the apex; and a second leg extending away from the second side of the apex, wherein the projectile is removably engageable by the second end tip and by the hook such that the head and the projectile extend co-planar with each other.

8. The flip toy launcher assembly according to claim 7, wherein the hook has a first through opening and the second free end has a second through opening, and wherein the launcher further comprises a strap extending between the first through opening and the second through opening.

9. The flip toy launcher assembly according to claim 8, wherein the projectile is configured to be inserted over the second end such that the apex of the projectile rests on the second end, between the handle and the strap.

10. The flip toy launcher assembly according to claim 7, wherein the elongate handle has a slot formed therein between the top end and the bottom end, and wherein the hook is slidably inserted into the slot.

11. The flip toy launcher assembly according to claim 10, wherein the downwardly directed hook is slidable along the elongate handle.

12. The flip toy launcher assembly according to claim 7, wherein the head further comprises a reverse hook extending upwardly from the second end tip toward the handle.

13. The flip toy launcher assembly according to claim 12, wherein the reverse hook has a wave-like profile.

* * * * *